US007542707B2

(12) United States Patent
Omata

(10) Patent No.: US 7,542,707 B2
(45) Date of Patent: Jun. 2, 2009

(54) IMAGE FORMING APPARATUS

(75) Inventor: Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 591 days.

(21) Appl. No.: 11/434,724

(22) Filed: May 17, 2006

(65) Prior Publication Data

US 2006/0275058 A1 Dec. 7, 2006

(30) Foreign Application Priority Data

Jun. 1, 2005 (JP) ..... 2005-162058
Apr. 6, 2006 (JP) ..... 2006-105753

(51) Int. Cl.
*G03G 15/01* (2006.01)

(52) U.S. Cl. ..... 399/302; 399/222; 399/299

(58) Field of Classification Search ..... 399/222, 399/223, 231, 297–300, 302, 303
See application file for complete search history.

(56) References Cited

U.S. PATENT DOCUMENTS

| | | | | |
|---|---|---|---|---|
| 7,430,389 | B2 * | 9/2008 | Noguchi et al. | 399/223 |
| 2001/0028805 | A1 | 10/2001 | Haneda | 399/51 |
| 2002/0167681 | A1 | 11/2002 | Ide et al. | 358/1.9 |
| 2003/0223792 | A1 | 12/2003 | Chen et al. | 399/341 |
| 2008/0138121 | A1 * | 6/2008 | Tamaki | 399/302 |

FOREIGN PATENT DOCUMENTS

| | | |
|---|---|---|
| EP | 1 367 452 A2 | 12/2003 |
| JP | 7-266614 | 10/1995 |
| JP | 2002-341619 | 11/2002 |
| JP | 2004-271660 A | 9/2004 |

OTHER PUBLICATIONS

W.A. Lee, "The Glass Transition Temperatures of Polymers", Polymer Handbook, Second Edition, III, pp. 139 through 111-192.

* cited by examiner

*Primary Examiner*—David M Gray
*Assistant Examiner*—Ruth N Labombard
(74) *Attorney, Agent, or Firm*—Fitzpatrick, Cella, Harper & Scinto

(57) ABSTRACT

An image forming apparatus including: colored toner image forming devices each developing an electrostatic image with colored toner to form a colored toner image; a transparent toner image forming device developing an electrostatic image with transparent toner to form a transparent toner image; a transfer device superimposing and transferring the colored toner images and the transparent toner image on a transfer medium; and a fixing device fixing the superimposed toner images on the transfer medium. An image forming operation by the transparent toner image forming device is controlled in such a manner that the heights of the superimposed toner images fixed by the fixing device are substantially constant. The transparent toner has an absolute value for a charge amount per unit weight smaller than an absolute value for the charge amount of each of the colored toners per unit weight.

9 Claims, 7 Drawing Sheets

IMAGE FORMING APPARATUS

BACKGROUND OF THE INVENTION

1. Field of the Invention

The present invention relates to an image forming apparatus which: forms an electrostatic image on an image-bearing member in accordance with image data of a manuscript by, for example, an electrophotographic printing method or an electrostatic recording method; develops the electrostatic image with a developer containing colored toner charged to predetermined polarity to provide a toner image; transfers the toner image on a recording material; and fixes the image to provide a color image having gloss. The present invention relates to an image forming apparatus such as a printer, a copying machine, or a facsimile.

2. Related Background Art

FIG. 1 shows an example of a color image forming apparatus according to an electrophotographic printing method. The image forming apparatus of this example will be briefly described on the basis of FIG. 1.

A color electrophotographic image forming apparatus 100 of this example has five image forming portions P (Pa, Pb, Pc, Pd, and Pe) arranged in parallel with one another in a horizontal direction. Each of the image forming portions P (Pa, Pb, Pc, Pd, and Pe) has the corresponding one of drum-shaped electrophotographic photosensitive members (hereinafter referred to as "photosensitive drums") 1 (1*a*, 1*b*, 1*c*, 1*d*, and 1*e*) as an image-bearing member.

Each of the photosensitive drums 1 (1*a*, 1*b*, 1*c*, 1*d*, and 1*e*) is rotated clockwise by driving means in FIG. 1. In addition, each of the photosensitive drums 1 (1*a*, 1*b*, 1*c*, 1*d*, and 1*e*) has the corresponding one of charging devices 2 (2*a*, 2*b*, 2*c*, 2*d*, and 2*e*) for uniformly charging the surfaces of the photosensitive drums 1, the corresponding one of exposing devices 3 (3*a*, 3*b*, 3*c*, 3*d*, and 3*e*), the corresponding one of developing devices 4 (4*a*, 4*b*, 4*c*, 4*d*, and 4*e*), and the corresponding one of cleaning devices 5 (5*a*, 5*b*, 5*c*, 5*d*, and 5*e*) arranged on its periphery.

In addition, a conveying belt 7 serving as recording material conveying means for conveying a recording material S to each of the image forming portions P (Pa, Pb, Pc, Pd, and Pe) is arranged. The conveying belt 7 is tensioned between a driver roller 81 and support rollers 82 and 83, and is rotated in the direction indicated by an arrow.

In each of the image forming portions P (Pa, Pb, Pc, Pd, and Pe), the surface of any one of the photosensitive drums 1 (1*a*, 1*b*, 1*c*, 1*d*, and 1*e*) uniformly charged by the corresponding one of the charging devices 2 (2*a*, 2*b*, 2*c*, 2*d*, and 2*e*) is irradiated with a light image by the corresponding one of the exposing devices 3 (3*a*, 3*b*, 3*c*, 3*d*, and 3*e*), whereby an electrostatic latent image is formed.

The electrostatic latent image of each of the photosensitive drums 1 (1*a*, 1*b*, 1*c*, 1*d*, and 1*e*) is developed by the corresponding one of the developing devices 4 (4*a*, 4*b*, 4*c*, 4*d*, and 4*e*) to be a visible image, that is, a toner image.

That is, each of the developing devices 4 (4*a*, 4*b*, 4*c*, 4*d*, and 4*e*) is filled with a predetermined amount of cyan, magenta, yellow, black, or transparent toner as a developer by a supplying device (not shown). The developing devices 4 (4*a*, 4*b*, 4*c*, 4*d*, and 4*e*) develop the latent images on the photosensitive drums 1 (1*a*, 1*b*, 1*c*, 1*d*, and 1*e*) to visualize the images as a cyan toner image, a magenta toner image, a yellow toner image, a black toner image, and a transparent toner image.

The recording material S is stored in a recording material cassette 10, and is supplied from the cassette to the conveying belt 7 via multiple conveying rollers 11 and a registration roller 12. The recording material S is conveyed by the conveying belt 7 to be sequentially fed to transfer portions opposite to the photosensitive drums 1 (1*a*, 1*b*, 1*c*, 1*d*, and 1*e*). The toner images are transferred on the material by transfer blades 6 (6*a*, 6*b*, 6*c*, 6*d*, and 6*e*) as transfer means provided for the transfer portions.

Next, the recording material S on which the toner images have been transferred is separated from the conveying belt 7, and the separated recording material S is conveyed by a conveying portion 13 to a fixing device 9.

The recording material S on which the four color toner images and the transparent toner image have been transferred is subjected to fixation so that the mixing of the toner images and the fixation of the images to the recording material S are performed. Thus, a full-color copy image is formed, and is discharged to a sheet discharge tray 14.

FIG. 2 shows an example of each of the developing devices 4 (4*a*, 4*b*, 4*c*, 4*d*, and 4*e*) used in the image forming apparatus having the above construction. All the developing devices 4*a*, 4*b*, 4*c*, 4*d*, and 4*e* have the same construction. The developing devices 4 will be described.

In this example, each of the developing devices 4 is provided with a developing sleeve 40 as a developer carrying member, a magnet roller 41, a regulating member 42, developer conveying screws 43 and 44, and the like.

The developing sleeve 40 has the magnet roller 41 provided with multiple magnetic poles (S1, N1, S2, N2, and N3) fixed and included therein, and is rotated while a predetermined developing interval is maintained between the sleeve and the peripheral surface of the one of the photosensitive drums 1. The regulating member 42 has rigidity and magnetism, and may be arranged in various ways. For example, the member may be arranged while a predetermined interval is maintained between the member and the developing sleeve 40, or may be brought into pressure contact with the developing sleeve 40 under a predetermined load with no developer interposed between the member and the sleeve.

Any one of development methods can be used. To be specific, a preferable method involves: applying an alternating voltage to the developing sleeve 40 to form an alternating electric field in a developing region A where the developing sleeve 40 and the photosensitive drums 1 are opposite to each other; and performing development in a state where a magnetic brush is in contact with the photosensitive drum 1.

A distance between the developing sleeve 40 and the photosensitive drum 1 (an S-D distance) is desirably 100 to 1,000 μm for preventing carrier adhesion and for improving dot reproducibility. When the distance is smaller than 100 μm, a developer is apt to be insufficiently supplied, so an image density reduces. When the distance exceeds 1,000 μm, a line of magnetic force from the developing magnetic pole S1 expands. As a result, the density of magnetic brushes reduces, dot reproducibility deteriorates, or a binding force on a carrier weakens, so carrier adhesion is apt to occur.

The peak-to-peak voltage of the alternating electric field is preferably 300 to 3,000 V, and the frequency of the alternating electric field is 500 to 10,000 Hz. Each of the peak-to-peak voltage and the frequency can be appropriately selected and used in accordance with a process. In this case, examples of the waveform of an alternating bias for forming the alternating electric field include a triangular wave, a rectangular wave, a sinusoidal wave, and a waveform obtained by changing a duty ratio. Development is preferably performed by applying a developing bias voltage (an intermittent alternating superimposed voltage) having a discontinuous alternating bias voltage to the developing sleeve in order to cope with a change in rate at which a toner image is formed. When the applied voltage is lower than 300 V, a sufficient image density is hardly obtained, and it may be impossible to collect the fog toner of a non-image portion favorably. When the voltage exceeds 3,000 V, a latent image is disturbed through a magnetic brush, so image quality may reduce.

In addition, the use of a dual-component developer having favorably charged toner can reduce a fog removal voltage (Vback), so the primary charging of each of the photosensitive drums 1 can be reduced. As a result, the lifetime of each of the photosensitive drums 1 can be lengthened. A value for Vback is preferably 200 V or less, or more preferably 150 V or less although the preferable range varies depending on a developing system. A development contrast of 100 to 400 V is used so that a sufficient image density can be obtained. The development contrast is preferably as high as possible, and is preferably 300 V or more in order that the gradation of the halftone of an image may be stabilized.

When the frequency is lower than 500 Hz, sufficient vibration is not applied upon return of the toner in contact with each of the photosensitive drums 1 to the developing sleeve, so fog is apt to occur although the degree of fog is related to a process speed. When the frequency exceeds 10,000 Hz, toner cannot follow an electric field, so image quality is apt to reduce.

In such conventional image forming apparatus as described above, no toner is used in a white portion in a produced recorded image. The optical properties of paper as a recording material directly determine the visual characteristics of the recorded image such as a color and gloss. On the other hand, most of the visual characteristics of a portion where large amounts of black toner or C, M, Y, and K-color toners (such as a concentrated brown toner) are superimposed and recorded are determined by the optical properties of the toners.

With regard to the gloss of a recorded image outputted by such image forming apparatus as described above, for example, in the above-described case of white and black, black generally has higher gloss than that of white. This is because the gloss of toner is generally higher than that of paper as described above.

As a result, there arises a problem in that image quality is significantly impaired by a difference in gloss between pixels in an output image.

Furthermore, the height of toner at a portion having a high density is about 5 to 10 μm, so there arises a problem in that the irregularities of a toner image are so remarkable that image quality is reduced.

As an image forming apparatus taking such gloss and irregularities of toner as described above in consideration, as described in, for example, Japanese Patent Application Laid-Open No. H07-266614, there has been proposed a method involving: calculating the height of toner at an image portion to be formed on the surface of a recording material from image data by a toner height calculating portion; calculating the amount of transparent toner having gloss to be printed on each portion from a difference between the height of the toner at the image portion and the maximum value for the toner height by a transparent toner print amount calculating portion; printing the transparent toner in an amount needed for eliminating the irregularities of the toner on a toner image to provide a recorded article; imparting gloss to the recorded article; and eliminating surface irregularities to provide a glossy image.

However, the method involving smoothing a surface by transparent toner involves the formation of an image by the same amount of the transparent toner as that of the maximum toner amount of colored toner.

In other words, the same amount of the transparent toner as that of the maximum toner amount produced by appropriately superimposing four colors (cyan, magenta, yellow, and black) must be used to form an image at a portion where the image is formed by the transparent toner.

For example, in the case where image processing involving the superimposition of two or more colored toners is used, when the maximum toner amount of each colored toner is 0.5 mg/cm$^2$, the transparent toner must be used in an amount of 1.0 mg/cm$^2$ or more once for image formation.

An image forming method similar to the image formation by colored toner involves difficulty in forming an image at one image forming portion by a larger amount of transparent toner as that of colored toner.

Detailed description will be given below with reference to FIG. 3.

Description will be given by taking, as an example, the electric potential of each of the photosensitive drums 1 and the electric potential of the developing sleeve 40 in ordinary image formation. When the charge amount of colored toner per unit weight (hereinafter referred to as the triboelectricity) in an environment (23° C., 50% Rh) is about −30 μC/g, a high voltage is applied to each of the charging devices 2 so that the surface electric potential of the photosensitive drum 1 is controlled to −650 V.

Meanwhile, an alternating bias obtained by superimposing a DC component of −500 V and an AC component of 1.2 kV p-p on each other is applied to the developing sleeve 40. When each of the photosensitive drums 1 is exposed to laser, the drum shows a light electric potential of −100 V at a site where an electrostatic latent image to serve as an image having the maximum density is formed.

Therefore, a development contrast is set to about 400 V when colored toner having a maximum bearing amount of 0.5 mg/cm$^2$ is developed.

In the case where transparent toner is used in such construction, if it is assumed that the triboelectricity of the transparent toner is about −30 μC/g as in the case of the triboelectricity of colored toner, an electric potential difference needed for developing 1.0 mg/cm$^2$ of the transparent toner is about 800 V. In this case, a latent image electric potential of about 900 V must be formed on each of the photosensitive drums 1. Providing the ordinary photosensitive drum 1 with such high electric potential is not realistic because charging performance is not stable owing to the performance of the photosensitive drum.

For example, the following control is also available: a development contrast in accordance with the maximum electric potential of the charge amount of each of the photosensitive drums 1 is 400 V, the value is defined as a value set for transparent toner, and the development contrast of colored toner is set to 200 V in accordance with the maximum toner amount of the colored toner. In this case, however, there arises a problem in that the gradation of the halftone of the colored toner is unstable.

SUMMARY OF THE INVENTION

According to the present invention, the maximum bearing amount of transparent toner can be obtained under stable image forming conditions.

In order to attain the above-mentioned object, an image forming apparatus of the present invention, includes:

colored toner image forming devices each forming an electrostatic image and developing the electrostatic image with colored toner to form a colored toner image; the colored toner image forming devices forming toner images by colored toners different from each other, a transparent toner image forming device forming an electrostatic image and developing the electrostatic image with the transparent toner to form a transparent toner image; the transparent toner having a charge amount per unit weight smaller than a charge amount of each of the colored toners per unit weight, and a transfer device superimposing and transferring the colored toner images and the transparent toner image on a transfer medium.

DESCRIPTION OF THE PREFERRED EMBODIMENTS

Hereinafter, an image forming apparatus according to the present invention will be described in more detail with reference to the drawings.

(Entire Construction of Image Forming Apparatus)

The image forming apparatus used in this example has the same construction and function as those of the conventional image forming apparatus that has been previously described with reference to FIG. 1. Therefore, the previous description is cited, and overlapping detailed description is omitted.

Figure 1:
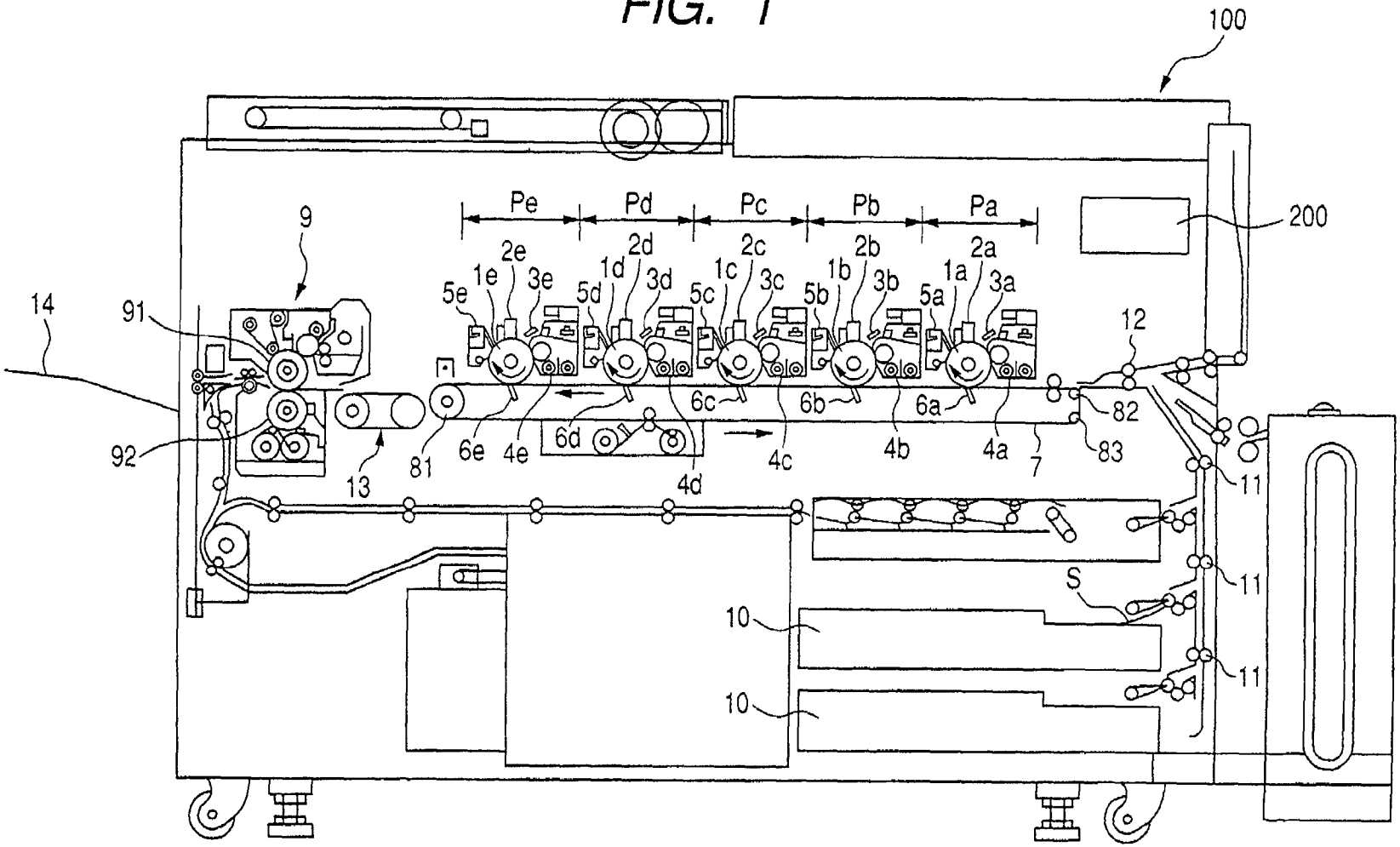
FIG. 1 is a view showing a schematic construction of an example of an image forming apparatus according to the present invention.

In other words, as shown in FIG. 1, the image forming apparatus 100 of this example has the five image forming portions P (Pa, Pb, Pc, Pd, and Pe) arranged in parallel with one another in a horizontal direction. Each of the image forming portions P (Pa, Pb, Pc, Pd, and Pe) has the corresponding one of drum-shaped electrophotographic photosensitive members, that is, the photosensitive drums 1 (1*a*, 1*b*, 1*c*, 1*d*, and 1*e*) as an image-bearing member in such a manner that the drums can rotate.

In addition, each of the photosensitive drums 1 (1*a*, 1*b*, 1*c*, 1*d*, and 1*e*) has the corresponding one of the charging devices 2 (2*a*, 2*b*, 2*c*, 2*d*, and 2*e*) for uniformly charging the surfaces of the photosensitive drums 1, the corresponding one of the exposing devices 3 (3*a*, 3*b*, 3*c*, 3*d*, and 3*e*), the corresponding one of the developing devices 4 (4*a*, 4*b*, 4*c*, 4*d*, and 4*e*), and the corresponding one of the cleaning devices 5 (5*a*, 5*b*, 5*c*, 5*d*, and 5*e*) arranged on its periphery.

In each of the image forming portions P (Pa, Pb, Pc, Pd, and Pe), the surface of any one of the photosensitive drums 1 (1*a*, 1*b*, 1*c*, 1*d*, and 1*e*) uniformly charged by the corresponding one of the charging devices 2 (2*a*, 2*b*, 2*c*, 2*d*, and 2*e*) is irradiated with a light image by the corresponding one of the exposing devices 3 (3*a*, 3*b*, 3*c*, 3*d*, and 3*e*), whereby an electrostatic latent image is formed. The image forming portions Pa, Pb, Pc, and Pd are colored toner image forming devices, and the image forming portion Pe is a transparent toner image forming device.

The electrostatic latent image of each of the photosensitive drums 1 (1*a*, 1*b*, 1*c*, 1*d*, and 1*e*) is developed by the corresponding one of the developing devices 4 (4*a*, 4*b*, 4*c*, 4*d*, and 4*e*) to be a visible image, that is, a toner image.

Each of the developing devices 4 (4*a*, 4*b*, 4*c*, 4*d*, and 4*e*) is filled with a predetermined amount of cyan, magenta, yellow, black, or transparent toner as a developer by a supplying device (not shown). The respective developing devices 4*a*, 4*b*, 4*c*, 4*d*, and 4*e* develop the latent images on the photosensitive drums 1*a*, 1*b*, 1*c*, 1*d*, and 1*e* to visualize the images as a cyan toner image, a magenta toner image, a yellow toner image, a black toner image, and a transparent toner image.

Hereinafter, the toners of the respective colors are abbreviated as follows: the cyan toner is abbreviated as the C toner, the magenta toner is abbreviated as the M toner, the yellow toner is abbreviated as the Y toner, the black toner is abbreviated as the K toner, and the transparent toner is abbreviated as the T toner.

The toner images on the respective photosensitive drums 1 (1*a*, 1*b*, 1*c*, 1*d*, and 1*e*) are transferred on the recording material S carried on and conveyed by the conveying belt 7. Furthermore, the recording material S on which the toner images of the respective colors have been transferred is subjected to the fixation of the toner images under heat and pressure by the fixing device 9 equipped with a fixing roller 91 and a pressure roller 92. After that, the recording material is discharged as a recorded image to the outside of the apparatus.

The image forming apparatus has a mode in which image formation is performed by colored toners of cyan, magenta, yellow, and black and a mode in which image formation is performed by superimposing a transparent toner on an image region where the images of these colored toners are formed.

Any colored toner except cyan, magenta, yellow, or black toner can also be used. For example, the following procedure can be adopted: toner having the same hue as that of one of those toners and having a low density is used, and both toner having a high density and toner having a low density are used to form an image so that reproducibility is improved.

(Formation of Transparent Toner Image)

Description will be given of a method of forming a transparent toner image as a characteristic of the present invention in which transparent toner is used to uniformize the heights of recorded images, that is, the heights of toners formed on the recording material S so that irregularities are eliminated.

Figure 4:
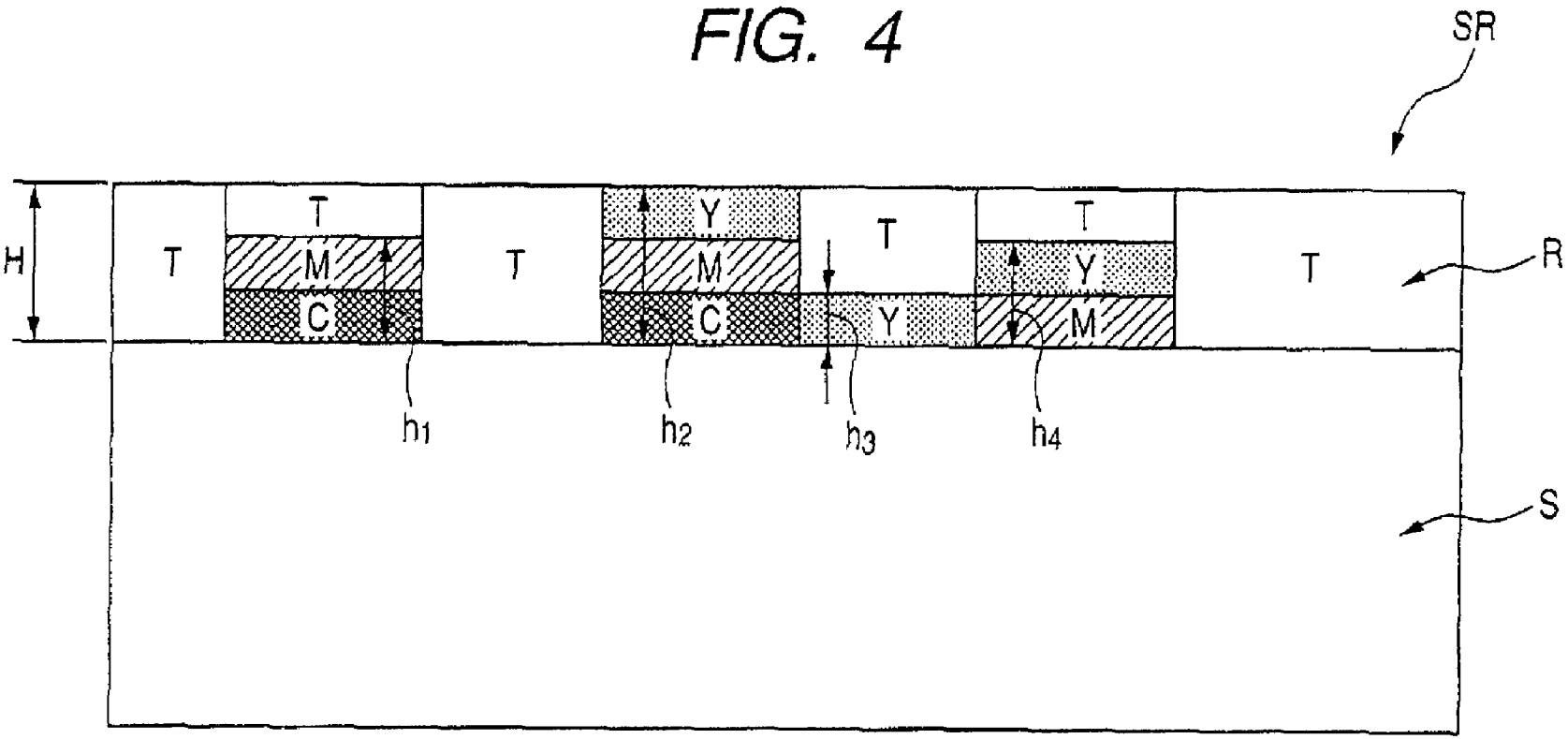
FIG. 4 is a view explaining an example of an eliminating effect on a step of an image by a transparent toner.

FIG. 4 shows the section of the recording material S on which a recorded image R is formed, that is, a recorded article SR.

The recording material S is paper, an OHP film, or the like. In addition, in this example, the recorded article SR refers to the recording material S on which the recorded image R is formed as a result of an image forming operation by the electrophotographic image forming apparatus 100.

As shown in FIG. 4, according to this example, on the basis of information about the height (h) of the recorded image R on the recording material S of the recorded article SR on which the image is recorded, additional recording by the transparent toner T is performed in such a manner that the maximum value (H) for the height (h) of the recorded image R in the image region and the height of the entire image in the region are identical to each other, thereby making the surface of the recorded article SR substantially smooth (making the heights of toner images substantially constant). Thus, uniform gloss can be imparted, and image recording providing improved image quality can be performed. The term "substantially smooth (substantially constant)" as used herein refers to a state where a variation of a toner image after fixation in a height direction is 3 μm or less.

The information about the height of the recorded image (toner image) R can be determined by, for example, a method involving reading the information from a table stored in advance on the basis of an image signal, a method involving determining the information through calculation by using basic information from a table, or a method involving measuring the height in a contact or non-contact manner.

The term "basic information" as used herein refers to information needed for calculating the height of a toner image on the recording material S, such as the bearing amount of the toner image with respect to recorded gradation (the gradation of an electrostatic image), the flowability of the toner image, and the structure value of the recording material S.

The height of the entirety is desirably substantially identical to the maximum value (H) for the heights (h1, h2, h3, h4, . . . ) of the recorded image R.

The maximum bearing amount of colored toner is determined by determining a color reproduction range through an appropriate combination of cyan, magenta, yellow, and black. In general, an image is designed in such a manner that the maximum bearing amount is about twice as high as a toner amount in which a single color provides the maximum density. When a wide color reproduction range is designed, the maximum bearing amount may be designed so as to be about 2.5 times as high as that of the toner amount.

Therefore, in order that the height of the entirety may be identical to the maximum value, the transparent toner, that is, the T toner must be printed in an amount about twice or more as high as that of each of the colored toners (C, M, Y, and K toners) on a so-called white portion on which no colored images (by the C, M, Y, and K toners) are mounted in an image region. In this case, the amount of the T toner to be used and the print amount of the toner drastically increase in an ordinary image. Therefore, the height is not necessarily needed to be identical to the maximum value. The amount of the T toner may be reduced to the extent that image quality is not greatly deteriorated.

A method substantially identical to that described in Japanese Patent Application Laid-Open No. H07-266614 can be used for determining the place on which the transparent toner (T toner) is mounted and the amount of the toner.

Figure 5:
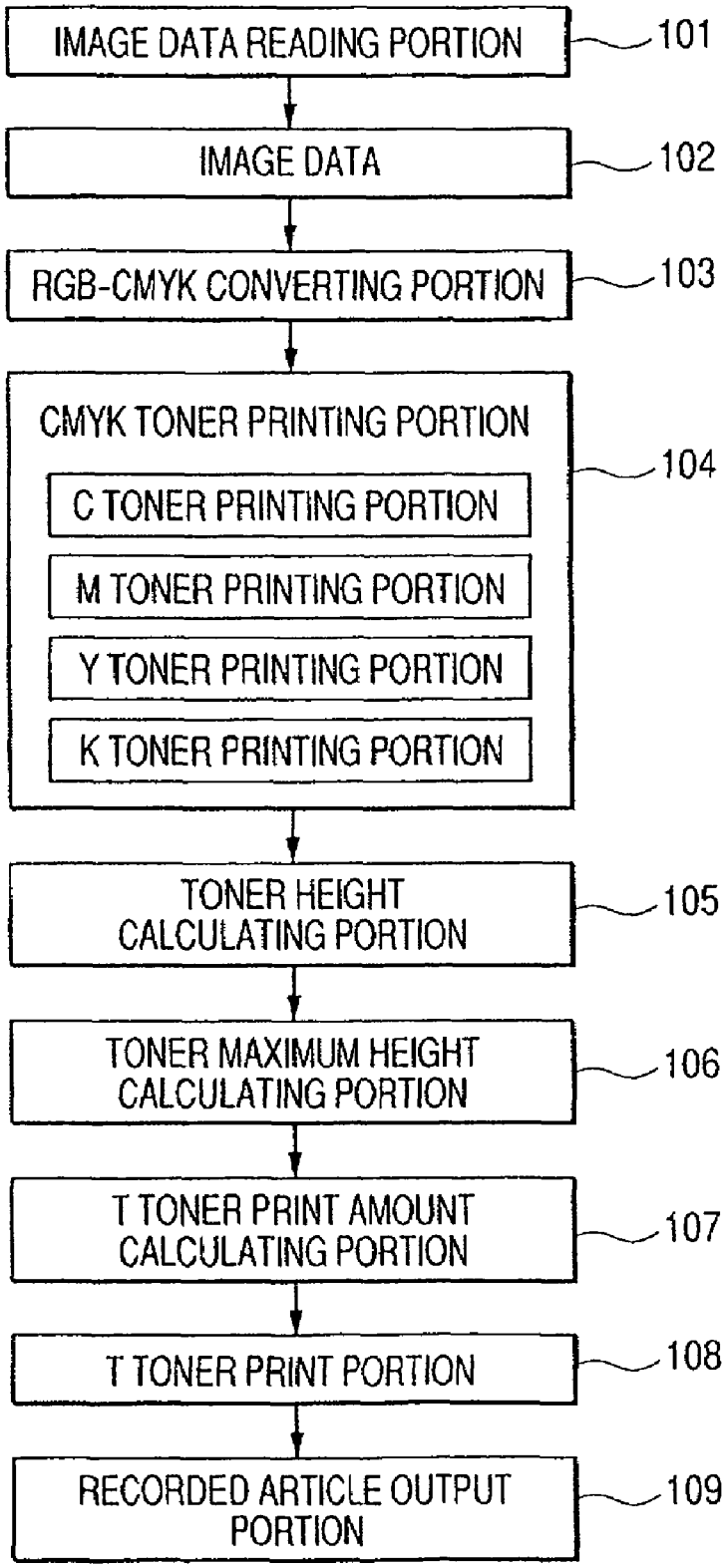
FIG. 5 is a view explaining an example of an image formation controlling operation by the transparent toner.

A method of determining the place on which the T toner is mounted and the amount of the toner will be described with reference to FIG. 5.

An RGB signal corresponding to each pixel of an image is recorded at 256 gray levels in image data 102 inputted from an image data reading portion 101. The RGB signal for each pixel is converted by an RGB-CMYK converting portion 103 into a print amount for the minimum print unit of four color toners.

The RGB-CMYK converting portion 103 can employ, for example, a method involving the use of a 3×4 masking matrix or a method involving: converting an RGB signal into a CMY signal by a 3×3 matrix; and performing so-called inking by a 3×4 matrix to produce Chinese ink K. In addition, so-called pseudo halftone representation can be used in this conversion. Each pixel of R, G, and B may not be in one-to-one correspondence with the minimum print unit of C, M, Y, and K toners. In that case, the print amount of each of the C, M, Y, and K toners for the minimum print unit is calculated.

Figure 2:
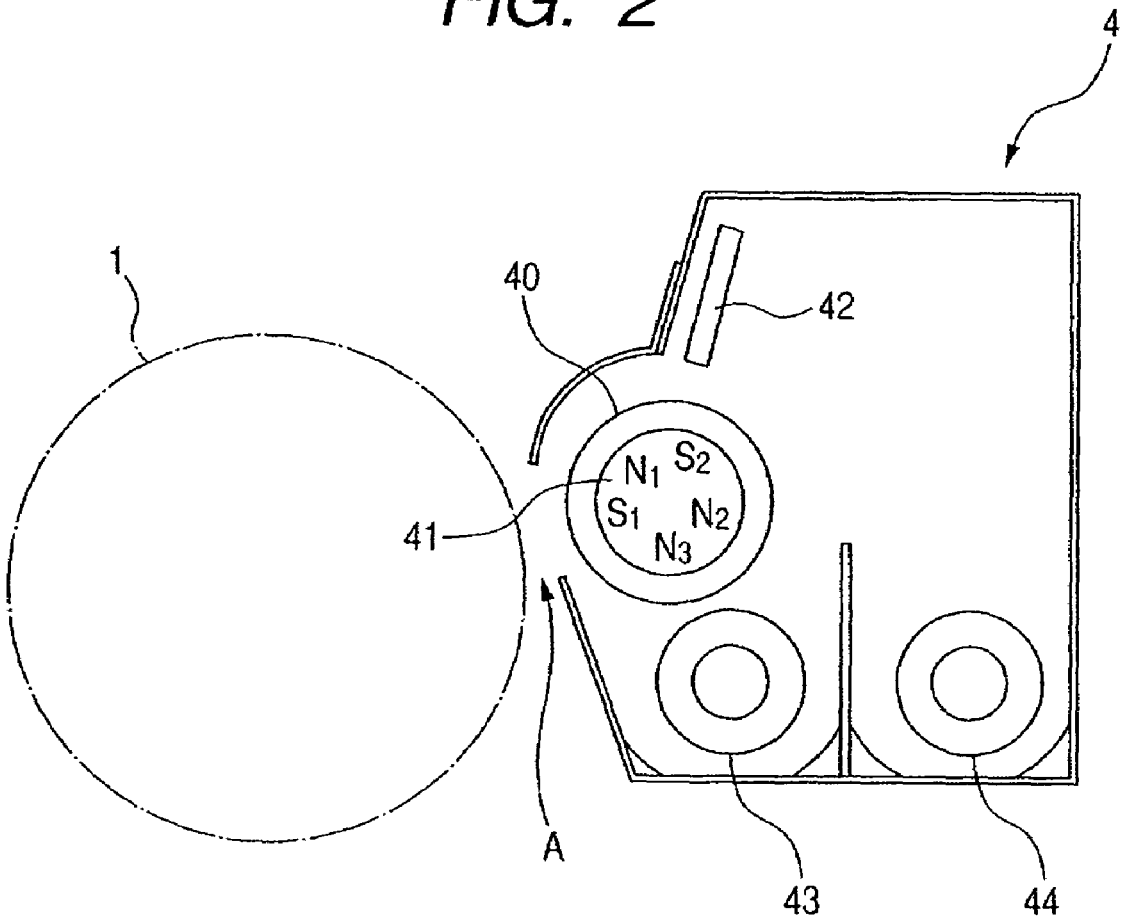
FIG. 2 is a view showing a schematic construction of an example of a developing device.
Figure 3:
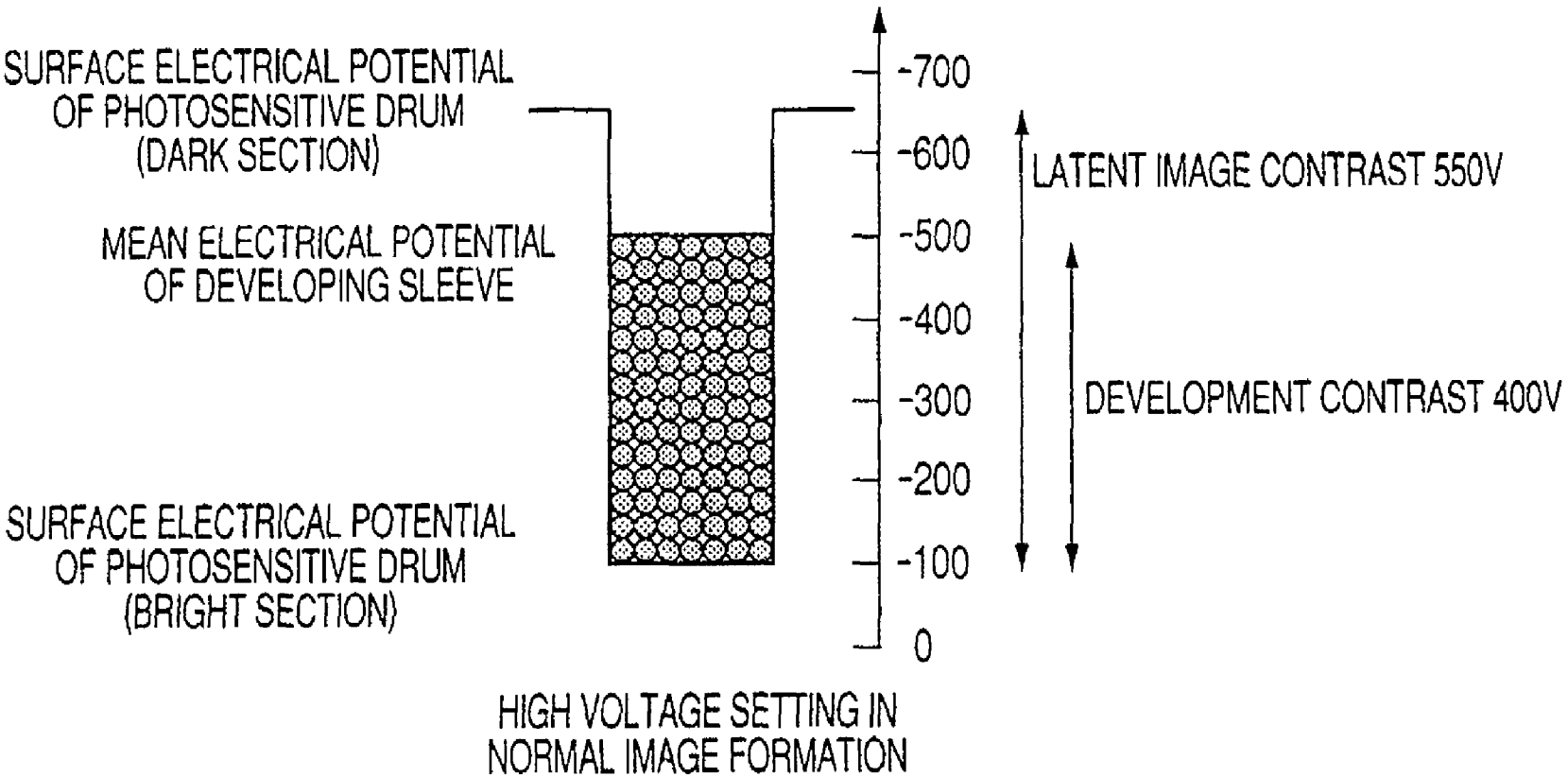
FIG. 3 is a view explaining a development method.

In CMYK toner printing portions 104, that is, the image forming portions P (Pa, Pb, Pc, and Pd) of the above image forming apparatus described with reference to FIGS. 1 and 2, toner images of the respective four colors are formed by an electrophotographic printing method in accordance with the print amount of each of the C, M, Y, and K toners.

A toner height calculating portion 105 determines the colored toner height for the minimum print unit through the calculation of the print amount of each of the C, M, Y, and K toners for the minimum print unit.

A toner maximum height calculating portion 106 determines the maximum height of printed toner in a specified image region from the colored toner height for the minimum print unit.

According to the present invention, with a view to uniformizing the heights of recorded images, that is, the heights of toner images formed on a recording material to eliminate irregularities, transparent toner, that is, T toner is used to fill in the irregularities of a colored toner image.

In view of the foregoing, in this example, a T toner print amount calculating portion 107 determines a difference between the toner maximum height and the colored toner height for each minimum print unit. The difference is defined as a T toner height in the minimum print unit. Next, a T toner print amount for obtaining the height is calculated for the minimum unit.

A T toner print portion 108, that is, the image forming portion Pe of the image forming apparatus 100 prints the T toner print amount for the minimum print unit calculated by the T toner print amount calculating portion 107.

A recorded article printed as a result of the performance of the above procedure by a controlling device 200 is output from a recorded article output portion 109, that is, the image forming apparatus 100. The recorded article is of a sectional shape shown in FIG. 4 described above, and has good image quality. The controlling device 200 controls the image forming operation of the image forming portion Pe. The term "image forming operation" as used herein refers to an operation for forming or developing an electrostatic image in an image forming portion.

(Developer)

Next, a developer used in this example will be described.

In this example, the developer contains such magnetic coat carrier and toner as described in, for example, Japanese Patent Application Laid-Open No. 2004-271660.

The surface of a carrier particle to be used in this example is coated with a resin and/or a coupling agent.

The coat carrier of this example is a lowly magnetized carrier having an intensity of magnetization (σ1,000) in 1,000/4π kA/m (79.58 kA/m) of 25 to 60 $Am^2/kg$, or preferably 25 to 50 $Am^2/kg$.

The magnetic properties of the coat carrier can be measured by, for example, a shaking magnetic field-type magnetic property automatic recording device BHV-35 manufactured by Riken Denshi Co., Ltd. The measurement conditions when the device is used are as described below. An external magnetic field of 1,000/4π (kA/m) is generated. Meanwhile, the coat carrier is sufficiently densely packed in a cylindrical, plastic container in such a manner that a carrier particle does not move. A magnetizing moment is measured in this state. The actual weight when the sample was placed is measured. Then, an intensity of magnetization ($Am^2/kg$) is determined.

The coat carrier of this example has a volume average particle diameter of preferably 25 to 60 μm, or more preferably 30 to 50 μm. When the volume average particle diameter of the carrier particles is less than 25 μm, carrier adhesion to a non-image portion due to particles on a fine particle side in the size distribution of the carrier particles may not be favorably prevented.

In addition, the size distribution of the coat carrier is desirably such that the content of carrier particles each having a particle diameter measured by a mesh method of 20 μm or less is 0.01 to 3 mass % and the content of carrier particles each having a particle diameter measured by the mesh method of 75 μm or more is 0.01 to 3 mass %. When the content of carrier particles each having a particle diameter of 20 μm or less is less than 0.01 mass %, the developer is apt to clog densely, and is apt to deteriorate, so the scattering of toner to the inside of a machine is apt to occur. When the content of carrier particles each having a particle diameter of 20 μm or less exceeds 3 mass %, carrier adhesion due to a carrier particle fine powder tends to occur. Similarly, when the content of carrier particles each having a particle diameter of 75 μm or more is less than 0.01 mass %, the developer is apt to deteriorate owing to a high density. When the content exceeds 3 mass %, a surface area needed for providing toner with an appropriate charge amount cannot be sufficiently obtained, so the scattering of toner to the inside of the machine is apt to occur similarly.

Furthermore, the magnetic property $\sigma 1{,}000$ of each of the carrier particles each having a particle diameter measured by the mesh method of 20 μm or less in $1{,}000/4\pi$ is preferably 30 to 50 $Am^2/kg$ in terms of carrier adhesion and the efficient stripping of the developer from the developer carrying member (that is, the developing sleeve 40).

The volume average particle diameter and size distribution of the coat carrier can be adjusted depending on, for example, the conditions under which the carrier particles are produced, the classification of the carrier particles by any one of sieves and various classifying devices, and the mixing of a classified product.

The volume average particle diameter of the coat carrier refers to a 50% average particle diameter on a volume basis measured by, for example, a laser diffraction-type size distribution meter (manufactured by HORIBA, Ltd.).

In addition, the amount of a fine powder having a particle diameter of 20 μm or less measured by the mesh method and the amount of a coarse powder having a particle diameter measured by the mesh method of 75 μm or more can be measured by preparing a mesh of each aperture and by using, for example, an electromagnetic experimental sieve shaker (Analysette 3 manufactured by Fritsch Japan Co., Ltd.). When the shaker is used, measurement is performed according to the following method: Timer=5 min, Amplitude intensity=2, and the amount of a sample to be used is 500 g.

Examples of the carrier core, that is, the core include: a magnetic particle selected from the group consisting of magnetic metals such as iron, nickel, copper, zinc, cobalt, manganese, chromium, and rare earths each having an oxidized or unoxidized surface, and magnetic alloys, magnetic oxides, and magnetic ferrites of them; and a magnetic material dispersion resin carrier obtained by dispersing a magnetic powder into a resin.

The content of metal compound particles in the carrier particles of the magnetic material dispersion resin carrier is preferably 80 to 95 mass %.

The binder resin of the magnetic material dispersion resin carrier is preferably a thermosetting resin, or more preferably a resin, which is partially, or entirely crosslinked three-dimensionally such as a thermosetting resin containing a phenol resin. The use of this resin can strongly bind the dispersed metal compound particles, so the strength of the magnetic material dispersion resin carrier can be increased. In addition, the desorption of the metal compound particles hardly occurs even in the copying of a large number of sheets, and no scattering of toner to the inside of a machine occurs. As a result, an image with improved stability can be obtained.

In addition, the surface of the carrier of this example is coated with a coat resin and/or a coupling agent before use. The use of a thermosetting resin as the binder resin results in the formation of an improved coat excellent in adhesiveness and uniformity.

A method of producing the magnetic material dispersion resin carrier is not particularly limited. In this example, a production method based on a polymerization method involving polymerizing monomers each serving as a binder resin in a solution into which the monomers, the metal compound particles, and a solvent are uniformly dispersed or dissolved to produce particles, in particular, a method involving subjecting the metal compound particles dispersed into carrier particles to a lipophilic treatment to produce a magnetic material dispersion resin carrier having a sharp size distribution and containing no fine powder is suitably used.

A monomer-polymerizable monomer (a radical-polymerizable monomer) can be used for the monomer to be used for a binder resin of a magnetic material dispersion resin carrier. Examples of the monomer-polymerizable monomer include, for example, styrene; styrene derivatives such as o-methyl styrene, m-methyl styrene, p-methoxy styrene, p-ethyl styrene, and p-tertiary butyl styrene; acrylates such as acrylic acid, methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate, and phenyl acrylate; methacrylates such as methacrylic acid, methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminomethyl methacrylate, diethylaminoethyl methacrylate, and benzyl methacrylate; 2-hydroxyethyl acrylate, 2-hydroxyethyl methacrylate; acrylonitrile, methacrylonitrile, and acrylamide; vinyl ethers such as methyl vinyl ether, ethyl vinyl ether, propyl vinyl ether, n-butyl ether, isobutyl ether, β-chloroethyl vinyl ether, phenyl vinyl ether, p-methyl phenyl ether, p-chlorophenyl ether, p-bromophenyl ether, p-nitrophenyl vinyl ether, and p-methoxyphenyl vinyl ether; and a dien compound such as butadiene.

Each of those monomers can be used alone, or two or more of them can be used as a mixture. Appropriate polymer composition providing preferable properties can be selected.

As described above, the binder resin of the magnetic material dispersion resin carrier is preferably crosslinked three-dimensionally, and a crosslinking agent forming such crosslinkage is preferably used. A crosslinking agent having two or more polymerizable double bonds per one molecule is preferably used as the crosslinking agent.

Examples of a crosslinking agent include: aromatic divinyl compounds such as divinylbenzene and divinylnaphthalene; ethylene glycol diacrylate, ethylene glycol dimethacrylate, triethylene glycol dimethacrylate, tetraethylene glycol dimethacrylate, 1,3-butylene glycol dimethacrylate, trimethylol propane triacrylate, trimethylol propane trimethacrylate, 1,4-butanediol diacrylate, neopentyl glycol diacrylate, 1,6-hexanediol diacrylate, pentaerythiritol tricrylate, pentaerythiritol tetracrylate, pentaerythiritol dimethacrylate, pentaerythiritol tetramethacrylate, glycerol acroxy dimethacrylate, N,N-divinyl anilene, divinyl ether, divinyl sulfide, and divinyl sulfone.

Two or more kinds of those crosslinking agents may be appropriately mixed and used. A crosslinking agent may be mixed in advance with a polymerizable mixture, or may be appropriately added during polymerization as required.

Examples of other monomers of the binder resin to be used in the magnetic material dispersion resin carrier include: bisphenols and epichlorohydrin serving as starting materials for an epoxy resin; phenols and aldehydes serving as starting materials for a phenol resin; urea and aldehydes serving as starting materials for a urea resin; and melamine and aldehydes serving as starting materials for a melamine resin.

Most preferable binder resin is a phenol resin. Examples of a starting material of the phenol resin include: phenol compounds such as phenol, m-cresol, 3,5-xylenol, p-alkylphenol, resolcynol, and p-tert-butylphenol; aldehyde compounds such as formalin, paraformaldehyde, and furfral. A combination of phenol and formalin is particularly preferable.

When any one of those phenol resins and melamine resins is used, a basic catalyst can be used as a curing catalyst. Any one of various catalysts used for the ordinary production of a resol resin can be used as the basic catalyst. Specific examples of the basic catalyst include amines such as ammonia water, hexamethylenetetramine, diethyltriamine, and polyethyleneimine.

Examples of the metal compound particles to be used in the magnetic material dispersion resin carrier include magnetite and ferrite each showing magnetism and each represented by a formula $MO.Fe_2O_3$ or $MFe_2O_4$. In each of the formulae, M represents a trivalent, divalent, or monovalent metal ion.

Examples of M include Mg, Al, Si, Ca, Sc, Ti, V, Cr, Mn, Fe, Co, Ni, Cu, Zn, Sr, Y, Zr, Nb, Mo, Cd, Sn, Ba, Pb, Li, and the like.

Either a compound of which M is single or a compound including plural kinds of M can be used for each of the metal compound particles. Examples of the metal compound particles include, for example, an iron-based oxide such as a magnetite, a Zn—Fe based ferrite, an Mn—Zn—Fe based ferrite, a Ni—Zn—Fe based ferrite, an Mn—Mg—Fe based ferrite, a Ca—Mn—Fe based ferrite, a Ca—Mg—Fe based ferrite, an Li—Fe based ferrite, and a Cu—Zn—Fe based ferrite.

The carrier preferably contains ferromagnetic metal compound particles of magnetite, ferrite, and the like described above, and metal oxide particles each showing weaker magnetism than that of each of the metal compound particles (which may hereinafter be simply referred to as "metal oxide particles") as the metal compound particles. The magnetism of each of the metal oxide particles has only to be weaker than that of each of the metal compound particles, and the metal oxide particles may be non-magnetic. Examples of such metal oxide particles include $Al_2O_3$, $SiO_2$, CaO, $TiO_2$, $V_2O_5$, CrO, $MnO_2$, $\alpha$-$Fe_2O_3$, CoO, NiO, CuO, ZnO, SrO, $Y_2O_3$, and $ZrO_2$.

When at least two kinds of metal compound particles are mixed and used as described above, metal compound particles having similar specific gravities and similar shapes are more preferably used for improving adhesiveness with the binder resin and improving the strength of each of the carrier particles. Examples of such combination that can be preferably used include: a combination of magnetite and hematite; a combination of magnetite and $\gamma$-$Fe_2O_3$; a combination of magnetite and $SiO_2$; a combination of magnetite and $Al_2O_3$; and a combination of magnetite and $TiO_2$. Out of those combinations, a combination of magnetite and hematite can be particularly preferably used.

When such metal compound particles as described above are used, the number average particle diameter of the metal compound particles each showing ferromagnetism is preferably 0.02 to 2 μm although the preferable range varies depending on the particle diameter of each of the carrier particles. When two or more kinds of metal compound particles are used, the number average particle diameter of the metal compound particles each showing ferromagnetism is preferably 0.02 to 2 μm, and the number average particle diameter of the metal oxide particles is preferably 0.05 to 5 μm.

In this case, a particle diameter ratio rb/ra of the number average particle diameter (the average particle diameter rb) of the metal oxide particles to the number average particle diameter (average particle diameter ra) of the metal compound particles each showing ferromagnetism is in the range of preferably 1.0 (exclusive) to 5.0 (inclusive), or more preferably 1.2 to 4.5 (both inclusive). When the ratio is 1.0 or less, a resistivity is low, and the metal compound particles each showing ferromagnetism are apt to appear on a surface. As a result, the specific resistance of each of the carrier particles can be hardly increased, and a preventing effect of carrier adhesion can be hardly obtained. When the ratio exceeds 5, the strength of each of the carrier particles is apt to reduce, and the breakage of the carrier particles is apt to occur, with the result of causing the scattering of toner to the inside of a machine.

The number average particle diameter of the metal compound particles can be measured by, for example, a transmission electron microscope H-800 manufactured by Hitachi, Ltd. A desirable method when the microscope is used involves: preparing a photographic image at a magnification of 5,000 to 20,000 by the microscope; randomly sampling 300 or more particles each having a particle diameter of 0.01 μm or more; measuring the Feret diameters of the particles in a horizontal direction as the particle diameters of the metal compound particles by, for example, an image processing and analyzing device Luzex 3 manufactured by Nireco Corporation; and averaging the measured particle diameters to calculate a number average particle diameter.

The content of the metal compound particles each showing ferromagnetism with respect to the entirety of the metal compound particles in the magnetic material dispersion resin carrier into which two or more kinds of metal compound particles are dispersed is preferably in the range of 70 mass % (exclusive) to 95 mass % (inclusive). When the content is 70 mass % or less, the resistance of the magnetic material dispersion resin carrier can be favorably increased, but the magnetic force of a carrier particle weakens, so carrier adhesion may occur. When the content exceeds 95 mass %, a more favorable increase in resistance of the magnetic material dispersion resin carrier cannot be achieved, and carrier adhesion may occur similarly although the degree of carrier adhesion varies depending on the specific resistance of each of the metal compound particles each showing ferromagnetism.

The metal compound particles in the magnetic material dispersion resin carrier of this example of the embodiment are preferably subjected to a lipophilic treatment for sharpening the size distribution of magnetic carrier particles and for preventing the desorption of the metal compound particles from the carrier particles. In particular, when the carrier particles are produced by the polymerization method, which is preferably used, particles insoluble, in a solution in which a monomer and a solvent are uniformized, are produced simultaneously with the progress of a polymerization reaction in the solution. At that time, the lipophilic treatment is expected to have an action in which a metal oxide is uniformly taken in particles at a high density, and an action in which the agglomeration of the particles is prevented so that the size distribution is sharpened.

Furthermore, the use of the metal compound particles subjected to the lipophilic treatment eliminates the need for using a suspension stabilizer such as calcium fluoride. As a result, the inhibition of charging characteristic due to a remaining of the suspension stabilizer on the surface of a carrier particle, the nonuniformity of a coat resin at the time of coating, and the inhibition of a reaction when the carrier is coated with a reactive substance such as at least one of a silicone resin and a coupling agent can be prevented.

The lipophilic treatment is preferably performed by an organic compound having one or two or more functional groups selected from an epoxy group, an amino group, and a mercapto group, or a lipophilic treatment agent as a mixture of organic compounds of such type. In particular, when the carrier particles are produced by the polymerization method which preferably used, treatment by a treatment agent having such groups as described above with a balance among lipophilicity, hydrophobicity, and hydrophilicity provides highly durable carrier particles each having stabilized charge imparting performance and high particle strength. An epoxy group is particularly preferably used.

100 parts by mass of the metal compound particles are preferably treated with 0.1 to 10 parts by mass (more preferably 0.2 to 6 parts by mass) of a lipophilic treatment agent for improving the lipophilicity and hydrophobicity of each of the metal compound particles.

Examples of a lipophilic agent having an amino group include, γ-aminopropyl-trimethoxysilane, γ-aminopropyl-methoxy-diethoxysilane, γ-aminopropyl-triethoxysilane, N-β(aminoethyl)-γ-aminopropyl-trimethoxysilane, N-β(aminoethyl)-γ-aminopropyl-methyldimethoxysilane, N-phenyl-γ-aminopropyl-trimethoxysilane, ethylenediamine, ethylenetriamine, a styrene-(meta)dimethyl aminoethyl acrylate copolymer, isopropyl tri(N-aminoethyl)titanate, and the like.

Examples of a lipophilic agent having a mercapt group include, mercaptoethanol, mercaptopropionic acid, γ-mercaptopropyl trimethoxysilane, and the like.

Examples of a lipophilic agent having an epoxy group include, γ-glycidoxypropyl methyldiethoxysilane, γ-glycidoxypropyl trimethoxysilane, β-(3,4-epoxycyclohexyl)trimethoxysilane, epichlorohydrin, glycidol, a styrene-(meth) glycidyl acrylate copolymer, and the like.

As described above, the surface of a carrier particle is preferably coated with a coat resin and/or a coupling agent before use from the viewpoints of an improvement in charge imparting property and an improvement in spent resistance; provided that the resin with which the surface is coated is not particularly limited.

Examples of such surface treatment resin include, for example, acrylic resins such as polystyrene and a styrene-acrylate copolymer, vinyl chloride, vinyl acetate, a polyvinylidene difluoride resin, a fluorocarbon resin, a perfluorocarbon resin, a solvent-soluble perfluorocarbon resin polyvinyl alcohol, polyvinyl acetal, polyvinyl pyrolidone, a petroleum resin, cellulose, a cellulose derivative, a novolac resin, a low-molecular-weight polyethylene, a saturated alkyl polyester resin, an aromatic polyester resin, a polyamide resin, a polyacetal resin, a polycarbonate resin, a polyether sulfone resin, a polysulfone resin, a polyphenylene sulfide resin, a polyether ketone resin, a phenol resin, a modified phenol resin, a maleic resin, an alkyd resin, an epoxy resin, an acrylic resin, an unsaturated polyester obtained by condensation polymerization of maleic anhydrite, terephthalic acid, and polyalcohol, an urea resin, a melamine resin, an urea-melamine resin, a xylene resin, a toluene resin, a guanamine resin, a melamine-guanamine resin, an acetoguanamine resin, a glyptal resin, a furan resin, a silicone resin, a polyimide resin, a polyamideimide resin, a polyetherimide resin, a polyurethane resin, a fluororesin, and the like.

Of those, a silicone resin and a fluorine resin are preferably used from the viewpoints of, for example, adhesiveness with the core and the prevention of spent, and each of them can be used alone; provided that each of them is preferably used in combination with a coupling agent for improving the strength of a coating film so that charging is controlled to a preferable one.

Furthermore, part of the above-described coupling agent is preferably used as a so-called primer agent for treating the core surface before coating with a resin. The use of the coupling agent as a primer agent can later result in the formation of a resin layer with improved adhesiveness due to a covalent bond.

As described above, in this example of the embodiment, any one of various silane compounds can be used as the coupling agent; provided that aminosilane as a silane compound having an amino group is desirably used. As a result, an amino group having positive chargeability can be introduced to the carrier surface, and a preferable charge amount can be provided for toner. Furthermore, the presence of the amino group can activate both the lipophilic treatment agent and the silicone resin with which a metal compound is preferably treated. As a result, adhesiveness between the silicone resin and a carrier particle can be further improved, and, at the same time, the curing of a resin is promoted, whereby a coating film with an improved strength can be formed.

Non-magnetic toner to be used in this example of the embodiment can be produced by a pulverization method. However, examples of a preferable method of producing non-magnetic toner in this example of the embodiment include methods of directly producing toner in a medium (polymerization methods) such as a suspension polymerization method, an interfacial polymerization method, and a dispersion polymerization method. Each of the polymerization methods involves: uniformly dissolving or dispersing a polymerizable monomer serving as a binder resin component and a coloring agent (and a polymerization initiator, a crosslinking agent, a charge control agent, other additives, and the like as required) to prepare a monomer composition; dispersing the monomer composition into a continuous layer (such as an aqueous phase) containing a dispersion stabilizer by an appropriate stirrer; and performing a polymerization reaction simultaneously with the stirring to produce toner having a desired particle diameter.

The non-magnetic toner preferably contains a mold releasing agent. Incorporating an appropriate amount of wax as a mold releasing agent can prevent the fusion of the toner to any one of the photosensitive drums 1 as image-bearing members while achieving compatibility between high resolution and offset resistance.

Examples of the wax that can be used in the non-magnetic toner include: petroleum-based waxes such as a paraffin wax, a microcrystalline wax, and petrolactum, and derivatives of them; a montan wax and a derivative thereof; a hydrocarbon wax based on a Fischer-Tropsch method and a derivative thereof; polyolefin waxes typified by polypropylene and polyethylene, and derivatives of them; and natural waxes such as a carnauba wax and a candelilla wax, and derivatives of them. Examples of the derivatives include an oxide, a block copolymer with a vinyl-based monomer, and a graft-denatured product. Higher aliphatic alcohols, aliphatic acids (such as stearic acid and palmitic acid) or compounds of the acids, amino acid waxes, ester waxes, ketones, hardened castor oil and a derivative thereof, vegetable waxes, animal waxes, and the like can also be used.

The content of any one of those waxes in the non-magnetic toner is preferably in the range of 0.5 to 25 parts by mass with respect to 100 parts by mass of the binder resin.

In case of nonmagnetic toner particles which is concerned to this examples of the embodiment produced by a grinding method, examples of a binder resin include styrene and a monopolymer of its substitution such as polystyrene and polyvinyl toluene; a styrene-based copolymer such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleate copolymer, and a styrene-ester maleate copolymer; polymethyl methacrylate, polybutyl methacrylate, polyvinyl acetate, polyethylene, polypropylene, polyvinyl butyral, a silicone resin, a polyester resin, a polyamide resin, a epoxy resin, and a polyacryl resin. These can be used alone or in admixture with each other. In particular, a styrene-based copolymer and a polyester resin are preferable in terms of the developing characteristics and the fixing characteristics.

When the non-magnetic toner according to this example of the embodiment is produced by a polymerization method, examples of the polymerizable monomer constituting a binder resin component include the following monomers.

Examples of the monomer which can be used herein include astyrene-based monomer such as styrene, o-methylstyrene, m-methylstyrene, p-methylstyrene, p-methoxystyrene, and p-ethylstyrene; ester acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chlorethyl acrylate, and phenyl acrylate; ester methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; other acrylonitrile, methacrylonitrile, and acrylamide. These monomers can be used alone or in admixture with each other. Of those monomers, the use of styrene or a styrene derivative alone or the use of styrene or a styrene derivative in admixture with other monomers is preferable in terms of the developing characteristics and the fixing characteristics.

In this example of the embodiment, the non-magnetic toner preferably contains a polyester resin.

According to the investigation conducted by the inventors of the present invention, adding a polyester resin improves the strength of the surface of the toner. When an additive such as an inorganic fine particle is extraneously added and used in combination with a color toner particle, an effect of preventing the embedding of the inorganic fine particle on the surface of a toner particle in the toner particle due to long-term duration becomes large, and charging is stabilized. As a result, the scattering of the toner to the inside of a machine due to long-term duration can be prevented.

The polyester resin preferably has a weight average molecular weight (Mw) of 6,000 to 100,000. When Mw is less than 6,000, an effect of preventing the embedding of an extraneous additive in a toner particle is small, so no effect of preventing a reduction in charge amount due to duration is observed. On the other hand, when Mw exceeds 100,000, the dispersion of a condensed resin into a toner particle deteriorates, with the result that the size distribution of the toner to be finally obtained becomes broad.

In each of the polymerization method and the pulverization method, the glass transition temperature (Tg) of the binder resin is in the range of preferably 40 to 70° C., or more preferably 45 to 65° C. A monomer having a glass transition temperature in the above range may be used alone. Alternatively, in general, monomers are appropriately mixed and used in such a manner that the theoretical glass transition temperature (Tg) described in the publication Polymer Handbook, second edition, III, p 139-192 (published by John Wiley & Sons) shows 40 to 70° C.

The colored non-magnetic toners in this example of the embodiment, that is, the C, M, and Y toners each contain a coloring agent so that coloring power is imparted to each of the toners. Examples of an organic pigment or dye to be preferably used in this example of the embodiment include the following pigments and dyes.

Examples of organic pigments or organic dyes as cyan-based tinctions, which can be used herein, include a copper phthalocyanine compound and its derivatives, an anthraquinone compound, and a lake compound of basic dyes. Specifically, C. I. pigment blue 1, C. I. pigment blue 7, C. I. pigment blue 15, C. I. pigment blue 15:1, C. I. pigment blue 15:2, C. I. pigment blue 15:3, C. I. pigment blue 15:4, C. I. pigment blue 60, C. I. pigment blue 62, and C. I. pigment blue 66 can be included.

Examples of organic pigments or organic dyes as magenta-based tinctions, which can be used herein, include an azo condensation compound, a diketopyrrolopyrrole compound, anthraquinone, a quinacridone compound, a lake compound of basic dyes, a naphthol compound, a benzimidazolone compound, a thioindigo compound, and a perylene compound. Specifically, C. I. pigment red 2, C. I. pigment red 3, C. I. pigment red 5, C. I. pigment red 6, C. I. pigment red 7, C. I. pigment violet 19, C. I. pigment red 23, C. I. pigment red 48:2, C. I. pigment red 48:3, and C. I. pigment red 48:4, C. I. pigment red 57:1, C. I. pigment red 81:1, C. I. pigment red 122, C. I. pigment red 144, C. I. pigment red 146, C. I. pigment red 166, C. I. pigment red 169, C. I. pigment red 177, C. I. pigment red 184, C. I. pigment red 185, C. I. pigment red 202, C. I. pigment red 206, C. I. pigment red 220, C. I. pigment red 221, and C. I. pigment red 254.

Examples of organic pigments or organic dyes as yellow-based tinctions, which can be used herein, are represented by an azo condensation compound, an isoindolinone compound, an anthraquinone compound, an azometal complexation, a methine compound, and an acrylamide compound. Specifically, C. I. pigment yellow 12, C. I. pigment yellow 13, C. I. pigment yellow 14, C. I. pigment yellow 15, C. I. pigment yellow 17, C. I. pigment yellow 62, C. I. pigment yellow 74, C. I. pigment yellow 83, C. I. pigment yellow 93, and C. I. pigment yellow 94, C. I. pigment yellow 95, C. I. pigment yellow 97, C. I. pigment yellow 109, C. I. pigment yellow 110, C. I. pigment yellow 111, C. I. pigment yellow 120, C. I. pigment yellow 127, C. I. pigment yellow 128, C. I. pigment yellow 129, C. I. pigment yellow 147, C. I. pigment yellow 151, C. I. pigment yellow 154, C. I. pigment yellow 168, C. I. pigment yellow 174, C. I. pigment yellow 175, and C. I.

pigment yellow 176, C. I. pigment yellow 180, C. I. pigment yellow 181, C. I. pigment yellow 191, and C. I. pigment yellow 194.

Each of the coloring agents can be used alone, or two or more can be used as a mixture. Furthermore, each of the coloring agents can be used in a solid solution state. The coloring agents used in the colored toners in this example are selected in terms of hue angle, chroma, brightness, light resistance, OHP transparency, and dispersibility into toner.

The amount of each of the coloring agents to be added is 1 to 20 parts by mass with respect to 100 parts by mass of the binder resin.

The non-magnetic toner in this example may be blended with a charge control agent for stabilizing charging property.

A known charge control agent can be used, and a charge control agent having a high charging speed and a capability of stably maintaining a constant charge amount is particularly preferable. Furthermore, when color toner is produced by a polymerization method, a charge control agent having low polymerization inhibiting property and containing substantially no matter made soluble in an aqueous dispersion medium is particularly preferable. Specific examples of a negatively chargeable charge control agent include: metal compounds of aromatic carboxylic acids such as salicylic acid, alkylsalicylic acid, dialkylsalicylic acid, naphthoic acid, and dicarboxylic acid; metal salt or metal complexes of azo dyes or azo pigments; polymer compounds, boron compounds, urea compounds, silicon compounds, and calixarene each having a sulfonic group or a carboxylic group at a side chain thereof. Specific examples of a positively chargeable charge control agent include: a quaternary ammonium salt; and a polymer compound, a guanidine compound, a nigrosin-based compound, and an imidazole compound each having the quaternary ammonium salt at a side chain thereof.

The charge control agent is preferably used in an amount of 0.5 to 10 parts by mass with respect to 100 parts by mass of the resin.

In the case where the nonmagnetic toner particles in the examples are produced by the polymerization method, a polymerization initiator preferably used in a production of the nonmagnetic toner particles is that the half-life of the polymerization initiator is 0.5 to 30 hours at a polymerization reaction and the polymerization initiator is used at a ratio of 0.5 to 20 parts by mass for a polymerization monomer of 100 parts by mass. Such a polymerization initiator can give desirable intensity and suitable solubility characteristics. Examples of the polymerization initiator which can be used herein include an azo-based or a diazo-based polymerization initiator such as 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile, and azobisisobutylonitrile; a peroxide based-polymerization initiator such as benzoyl peroxide, methylethylketone peroxide, diisopropyl peroxycarbonate, cumene hydroperoxide, 2,4-dichlorobenzoyl peroxide, lauroyl peroxide, and t-butylperoxi2-ethylhexanoate.

When the non-magnetic toner particles in the example are produced by a polymerization method, a crosslinking agent may be added. The amount of the agent to be added is preferably 0.001 to 15 mass % of the polymerizable monomer composition.

Basically, a cross-linker having two or more polymerizable double bonds is used herein. Examples of the cross-linker which can be used include an aromatic divinyl compound such as divinylbenzene and divinylnaphthalene; carboxylate ester having two double bonds such as ethylene glycol diacrylate, ethylene glycol dimethacrylate, and 1,3-butanediol methacrylate; a divinyl compound such as divinyl aniline, divinyl ether, divinyl sulfide, and divinyl sulfone; and a compound having three or more vinyl groups. These can be used alone or in admixture with each other.

When the non-magnetic toner particles in the example are produced by the polymerization method, in general, the above color toner composition, that is, the polymerizable monomer is appropriately added with components required for the toner such as the coloring agent, a mold releasing agent, a plasticizer, a charge control agent, and the crosslinking agent, and other additives. The mixture is uniformly dissolved or dispersed by a dispersing device such as a homogenizer, a ball mill, a colloid mill, or an ultrasonic dispersing device to prepare a polymerizable monomer system. The system is suspended into an aqueous medium containing a dispersion stabilizer. At this time, it is recommended that a high-speed dispersing device such as a high-speed agitator or the ultrasonic dispersing device be used to provide a desired toner particle size in a stroke because the size distribution of the resultant toner particles becomes sharp. A polymerization initiator may be added simultaneously with the addition of other additives to the polymerizable monomer, or may be mixed immediately before suspension into the aqueous medium. In addition, immediately after granulation, a polymerization initiator dissolved into the polymerizable monomer or the solvent can be added before the initiation of a polymerization reaction.

After granulation, stirring is only to be performed by an ordinary agitator to the extent that a particle state is maintained and the floating and sedimentation of a particle are prevented.

When the non-magnetic toner in the example is produced by the polymerization method, a known surfactant, or a known organic or inorganic dispersant can be used as a dispersion stabilizer. Of these, an inorganic dispersant can be preferably used. The reason for this is as described below. The inorganic dispersant hardly produces a harmful ultra-fine powder. The stability of the inorganic dispersant hardly collapses even when a reaction temperature is changed because the dispersant has a dispersion stability owing to the steric hindrance property. The inorganic dispersant can be easily washed, and has little adverse effect on the toner. Examples of such inorganic dispersant include: polyvalent metal phosphates such as calcium phosphate, magnesium phosphate, aluminum phosphate, and zinc phosphate; carbonates such as calcium carbonate and magnesium carbonate; inorganic salts such as calcium metasilicate, calcium sulfate, and barium sulfate; and inorganic oxides such as calcium hydroxide, magnesium hydroxide, aluminum hydroxide, silica, bentonite, and alumina.

Each of these inorganic dispersants is desirably used alone in an amount of 0.2 to 20 parts by mass with respect to 100 parts by mass of the polymerizable monomer. However, the use of each of these inorganic dispersants alone is insufficient to reduce the particle diameter of the toner although the use hardly generates an ultra-fine particle. Accordingly, the inorganic dispersants may be used in combination with 0.001 to 0.1 part by mass of the surfactant. Examples of the surfactant include sodium dodecylbenzene sulfonate, sodium tetradecyl sulfate, sodium pentadecyl sulfate, sodium octyl sulfate, sodium oleate, sodium laurate, sodium stearate, and potassium stearate.

Each of the inorganic dispersants may be used as it is. Particles of the inorganic dispersants can be produced in the aqueous medium for obtaining particles each having a reduced particle diameter. For example, in the case of calcium phosphate, an aqueous solution of sodium phosphate and an aqueous solution of calcium chloride are mixed under high-speed stirring, whereby water-insoluble calcium phosphate can be produced. As a result, dispersion can be performed with improved uniformity and improved finesse. At this time, a water-soluble sodium chloride salt is simultaneously produced as a by-product. The presence of a water-soluble salt in the aqueous medium is more convenient because the presence suppresses the dissolution of the polymerizable monomer into water, so ultra-fine toner due to emulsion polymerization is hardly produced. The aqueous medium is desirably exchanged, or the salt is desirably desalted by an ion-exchange resin because the salt becomes an obstruction upon removal of a remaining polymerizable monomer at a terminal stage of the polymerization reaction. The inorganic dispersants can almost be completely removed by dissolving into an acid or an alkali after the completion of polymerization.

In the polymerization step, polymerization is preferably performed at a polymerization temperature of 40° C. or higher, or generally 50 to 90° C. A reaction temperature can be increased up to 90 to 150° C. at a terminal stage of the polymerization reaction in order to consume the remaining polymerizable monomer.

After the completion of polymerization, the polymerized toner particles are filtered, washed, and dried by a known method, and an extraneous additive such as an inorganic fine particle is mixed with the particles so that the extraneous additive is caused to adhere to the surface of each of the particles. As a result, toner can be obtained. In another desirable mode, a classifying step is incorporated into a production step so that a coarse powder and a fine powder are filtered out.

When the non-magnetic toner particles are produced by a pulverization method, a known method is used. An example of the method involves: sufficiently mixing components needed for color toner particles such as a binder resin, a release agent, a charge control agent, and a coloring agent, other additives, and the like by a mixer such as a Henschel Mixer or a ball mill; melting and kneading the mixture by a heat kneader such as a heating roll, a kneader, or an extruder to make resins compatible with each other; cooling and solidifying the resultant; pulverizing the resultant; classifying the resultant; and subjecting the resultant to a surface treatment as required to produce toner particles. The classification may be performed prior to the surface treatment, or vice versa. A multi-division classifier is preferably used in the classifying step in terms of production efficiency.

The pulverizing step can be performed by a method involving the use of a known pulverizer such as a mechanical impact-type pulverizer or a jet-type pulverizer. In order to obtain color toner having a specific circularity, pulverization is preferably performed under additional heat, or an auxiliary treatment for applying a mechanical impact. A water bath method involving dispersing color toner particles that have been finely pulverized (and classified as required) into hot water, and a method involving passing the particles through a hot air current, or the like may also be performed.

Examples of means for applying a mechanical impact force include means for applying a mechanical impact force to non-magnetic toner particles with the aid of a compressive force, a frictional force, or the like by pressing the toner particles against the inside of a casing by a blade rotating at a high speed such as a Mechanofusion System manufactured by HOSOKAWAMICRON CORPORATION and a Hybridization System manufactured by NARA MACHINERY CO., LTD.

Furthermore, the non-magnetic toner particles to be used in this example can also be produced by any one of the methods of producing toner particles such as: a method described in JP 56-13945 B or the like involving atomizing a melted mixture in the air by using a disk or a multi-fluid nozzle to produce spherical toner particles; and polymerization methods except a suspension polymerization method, including (1) a dispersion polymerization method involving directly producing toner particles by using an aqueous organic solvent in which a monomer is soluble and a polymer to be obtained is insoluble, and (2) an emulsion polymerization method typified by a soap-free polymerization method involving directly performing polymerization in the presence of a water-soluble polar polymerization initiator to produce toner particles.

In this example, the non-magnetic toner contains inorganic fine particles each serving as an extraneous additive, and the primary average particle diameter of the inorganic fine particles is preferably 4 to 80 nm.

The inorganic fine particles are preferably subjected to the hydrophobic treatment for maintaining the charge amount of each tone particle at a high level even in a high-humidity environment and for preventing toner scattering.

For example, a method involving: performing a silylation reaction by using a silane coupling agent or the like as a first stage reaction; and eliminating a silanol group by chemical bond, or a method involving forming a hydrophobic thin film on a surface by using silicone oil is applicable to the hydrophobic treatment for the inorganic fine particles.

In this example, the average primary particle diameter of the inorganic fine particles is determined as a number average particle diameter according to the following procedure. The non-magnetic toner is subjected to macrophotography by a scanning electron microscope. The photograph of the non-magnetic toner is mapped with an element in each of the inorganic fine particles. While the photograph is referred to element analyzing means such as an XMA attached to the scanning electron microscope, the particle diameter of each of 100 or more primary particles of the inorganic fine particles adhering to or liberated from the surface of the non-magnetic toner is measured.

Fine particles of silica, alumina, titania, and the like can be used as the inorganic fine particles in this example.

For example, both so-called dry silica referred to as dry method silica or fumed silica produced by a vapor phase oxidation of a silicon halide, and so-called wet silica produced from water glass or the like can be used as silica fine particles. Of those, dry silica having a small number of silanol groups on the surface and inside generating a small amount of production residue such as $Na_2O$ or $SO_3^{2-}$ is preferable. In the production step of dry silica, for example, a metal halide such as aluminum chloride or titanium chloride, and a silicon halide can be used in combination to produce a composite fine powder of silica and other metal oxide, and the composite fine powder is also included in the scope of dry silica.

The amount of the inorganic fine particles to be added is preferably 0.1 to 3.0 parts by mass with respect to 100 parts by mass of non-magnetic toner particles. When the amount is less than 0.1 part by mass, an effect of the addition is not sufficient. When the amount exceeds 3.0 parts by mass, the liberation of the inorganic fine particles becomes remarkable, and the charge amount distribution of the toner expands, thereby the scattering of the toner to the inside of a machine may occur.

A small amount of other additives may be used in the non-magnetic toner used in this example to the extent that no substantial adverse effect is exerted on the toner. Examples of the other additives include: lubricant powders such as a polyethylene fluoride powder, a zinc stearate powder, and a polyvinylidene fluoride powder; abrasives such as a cerium oxide powder, a silicon carbide powder, and a strontium titanate powder; inorganic or organic fine particles each having a nearly spherical shape and a middle to large particle diameter (a primary particle diameter in excess of 30 nm) such as spherical silica particles and spherical resin particles intended for, for example, an improvement in cleaning property; and other organic and inorganic particles opposite in polarity to each other each serving as a developability improver. The surface of each of the additives can be subjected to hydrophobic treatment before use.

A T/C ratio of the non-magnetic toner particles to the carrier particles in the developer in this example is generally set to 3.0 to 12.0 mass %, or preferably 5.0 to 9.0 mass % so that good results can be obtained. When the toner concentration is less than 3.0 mass %, an image density is too low to be put into practical use, and the deterioration of the carrier is accelerated, with the result that the life time of the developer is shortened. When the toner concentration exceeds 12.0 mass %, the frequency of fog or scattering in a machine is increased, so the service life of the developer is shortened as well.

(Method of Measuring Triboelectricity of Toner)

Hereinafter, a method of measuring the triboelectricity (charge amount per unit weight) of the toner in a dual-component developer will be described with reference to the drawing.

Figure 6:
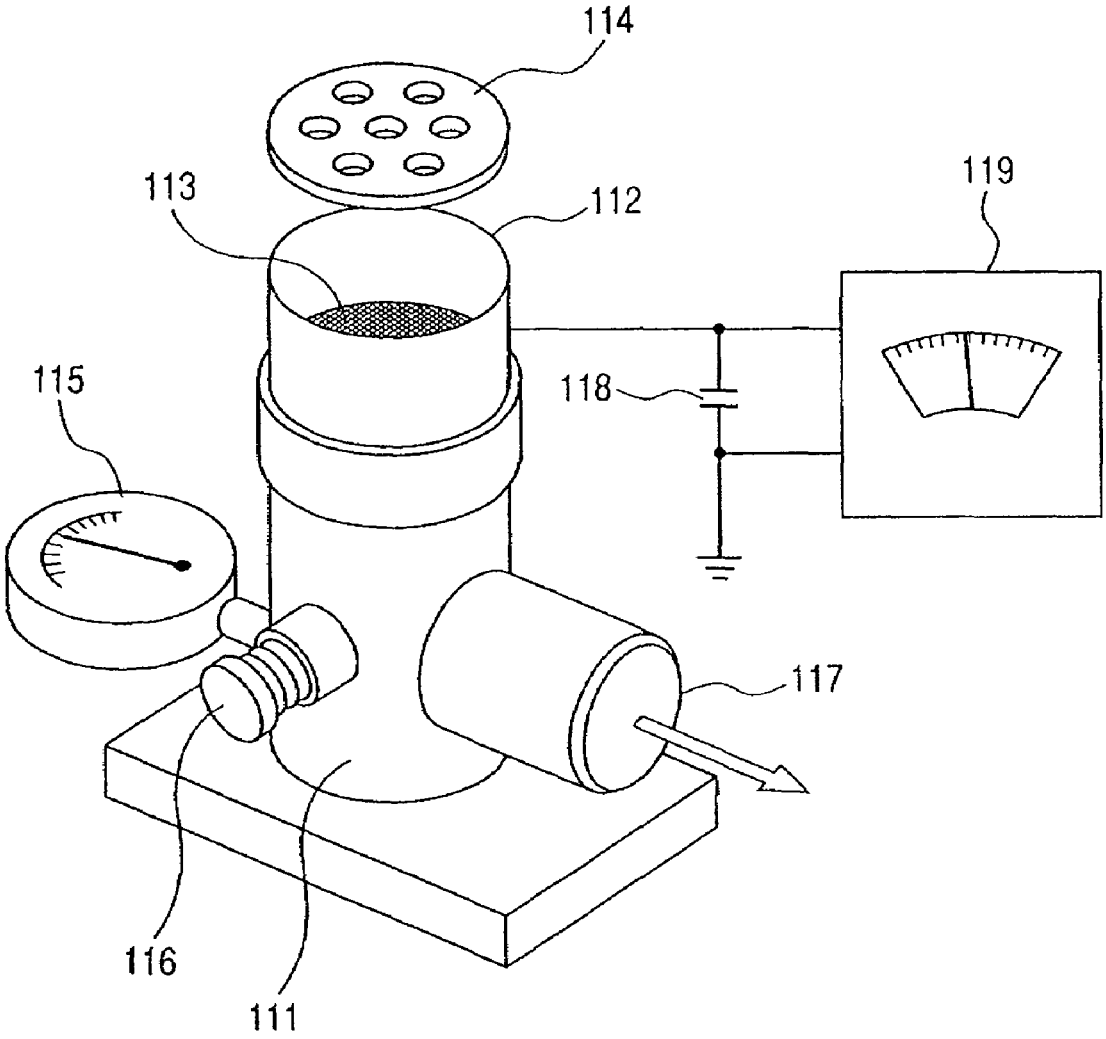
FIG. 6 is a schematic view explaining a method of measuring triboelectricity of the toner and an apparatus for measuring the triboelectricity.

FIG. 6 is an explanatory view of a device for measuring the charge amount of toner per unit weight (which may hereinafter be simply referred to as "triboelectricity").

First, a dual-component developer the triboelectricity of which is to be measured is placed in a polyethylene bottle having a volume of 50 to 100 ml, and is shaken by hand for about 10 to 40 seconds. Then, a metallic measuring container 112 having a 500-mesh screen 113 at the bottom is filled with about 0.5 to 1.5 g of the developer, and is covered with a metal lid 114.

The mass of the entirety of the measuring container 112 at this time is measured, and is denoted by W1 (kg). Next, a resin is sucked by a sucking device 111 (at least part of which in contact with the measuring container 112 is an insulator) from a suction port 117, and the pressure indicated by a vacuum gauge 115 is set to 250 mmAq by adjusting an air flow control valve 116. Suction is performed in this state sufficiently, or preferably for 2 minutes so that the resin is sucked and removed. The electric potential indicated by a potentiometer 119 at this time is denoted by V (volt). Here, a capacitor 118 has a capacity of C (F). In addition, the mass of the entirety of the measuring container 112 after the suction is measured, and is denoted by W2 (kg). The triboelectricity of the toner can be calculated from the following expression.

$$\text{Charge amount of toner per unit mass (C/kg)} = (C \times V \times 10^{-3})/(W1 - W2)$$

(Production of Carrier)

Carrier Production Example 1

| | |
|---|---|
| Phenol: | 3.6 parts by mass |
| Formalin solution (composed of about 40% of formaldehyde, about 10% of methanol, and the balance being water): | 5.4 parts by mass |

-continued

| | |
|---|---|
| Magnetite fine particles subjected to a lipophilic treatment with 1.0 mass % of γ-glycidoxypropyltrimethoxysilane (having an average particle diameter of 0.23 μm and a specific resistance of $4 \times 10^5$ Ω · cm): | 62.0 parts by mass |
| α-$Fe_2O_3$ fine particles subjected to a lipophilic treatment with 1.0 mass % of γ-glycidoxypropyltrimethoxysilane (having an average particle diameter of 0.57 μm and a specific resistance of $2.2 \times 10^9$ Ω · cm): | 26.0 parts by mass |

To the slurry, ammonia water as a basic catalyst, and water were poured in a flask. The temperature of the mixture was increased up to 85° C. in 40 minutes and held at the temperature while the mixture was stirred and mixed, followed by a reaction for 3 hours. A phenol resin was produced and cured. After that, the resultant was cooled, and the supernatant was removed after the addition of water. The precipitate was washed with water and dried under reduced pressure. Thus, spherical magnetic carrier core particles containing magnetite fine particles and each using the phenol resin as a binder resin were obtained.

The surface of each of the resultant carrier core particles was treated with 0.3 mass % of γ-aminopropyltrimethoxysilane diluted with a toluene solvent as a primer agent. Subsequently, the particles were coated with a mixture of 0.65 mass % of a straight silicone resin all substituents of which were methyl groups and 0.02 mass % of γ-aminopropyltrimethoxysilane by toluene as a solvent. Here, a coat agent is the straight silicone resin, and a coupling agent is γ-aminopropyltrimethoxysilane. Furthermore, the magnetic coat carrier was baked at 140° C., and agglomerated coarse particles were filtered out by a 100-mesh sieve. Next, a fine powder and a coarse powder were removed by using a multi-division air classifier so that a size distribution was adjusted. Thus, Coat Carrier No. 1 was obtained. The particle diameter of the carrier can be altered by changing the size of the mesh of the sieve.

Carrier Production Example 2

Coat Carrier No. 2 was produced in the same manner as in Carrier Production Example 1 except that the primer agent of the coat layer was removed, the amount of the coat agent was altered to 0.4%, and the amount of the coupling agent was altered to 0.01%. Table 1 shows the production methods for Coat Carrier No. 1 and Coat Carrier No. 2 obtained.

TABLE 1

| | Core particles | | | | Coat | | | | | |
|---|---|---|---|---|---|---|---|---|---|---|
| No. | Binder resin | Magnetic material | Non-magnetic material | Magnetic material/non-magnetic material | Primer agent | Addition amount (wt %) | Coat agent | Addition amount (wt %) | Coupling agent | Addition amount (wt %) |
| 1 | Phenol resin | Magnetite | Hematite | 70/30 | Amino-silane | 0.3 | Methyl silicone | 0.65 | Amino-silane | 0.02 |
| 2 | Phenol resin | Magnetite | Hematite | 70/30 | Amino-silane | 0 | Methyl silicone | 0.4 | Amino-silane | 0.01 |

(Production of Non-Magnetic Toner)

Non-Magnetic Toner Production Example 1

(A) Colored toners (C, Y, M, and K Toners)

250 parts by mass of a 0.1M aqueous solution of $Na_3PO_4$ were loaded into 405 parts by mass of ion-exchanged water, and the temperature of the mixture was increased to 60° C. After that, 40.0 parts by mass of a 1.07M aqueous solution of $CaCl_2$ were gradually added to the resultant, whereby an aqueous medium containing a calcium phosphate salt was obtained.

Meanwhile, the following prescription was uniformly dispersed and mixed by an Attritor (manufactured by MITSUI MIIKE MACHINERY CO., LTD.).

| | |
|---|---|
| Styrene: | 80 parts by mass |
| n-butyl acrylate: | 20 parts by mass |
| Divinylbenzene: | 0.2 part by mass |
| Saturated polyester resin (Mw = 41,000): | 4.0 parts by mass |
| Negatively chargeable charge control agent (Al compound of ditertiarybutylsalicylic acid): | 1 part by mass |
| C.I. Pigment Blue 15:3 | 6.0 parts by mass |

The temperature of the monomer composition was increased to 60° C., and 12 parts by mass of ester wax mainly composed of behenyl behenate (having the highest endothermic peak at 72° C. upon heat-up measurement in DSC) were added to, mixed with, and dissolved into the composition. 3 parts by mass of 2,2'-azobis(2,4-dimethylvaleronitrile) [t½=140 minutes at 60° C.] as a polymerization initiator were dissolved into the resultant.

The above polymerizable monomer system was loaded into the aqueous medium, and the whole was stirred by a TK homo mixer (manufactured by Tokushu Kika Kogyo) at 10,000 rpm for 15 minutes in an $N_2$ atmosphere at 60.5° C., followed by granulation. After that, the resultant was subjected to a reaction at 60.5° C. for 6 hours while the resultant was stirred by a paddle stirring blade. After that, stirring was continued for additional 4 hours with the liquid temperature kept at 80° C. After the completion of the reaction, distillation was performed at 80° C. for 3 hours. After that, a suspension was cooled, and was then added with hydrochloric acid so that the calcium phosphate salt was dissolved. The resultant was filtered and washed with water. Thus, wet colored particles were obtained.

Next, the particles were dried at 40° C. for 12 hours, whereby colored particles (toner particles) were obtained.

100 parts by mass of the toner particles and 1.2 parts by mass of hydrophobic silica fine particles treated with silicone oil and each having a BET value of 130 $m^2/g$ and a primary particle diameter of 12 nm were mixed by a Henschel Mixer (manufactured by MITSUI MIIKE MACHINERY CO., LTD.), whereby obtaining the Non-magnetic Toner (cyan toner) 1.

Non-magnetic Toner (magenta toner) 1 was produced in the same manner as in the production example of the cyan toner except that 8.0 parts by mass of C.I. Pigment Red 122 were used instead of 6.0 parts by mass of C.I. Pigment Blue 15:3.

Similarly, Non-magnetic Toner (yellow toner) 1 was produced in the same manner as in the production example of the cyan toner except that 8.0 parts by mass of C.I. Pigment Yellow 17 were used instead of 6.0 parts by mass of C.I. Pigment Blue 15:3.

Similarly, Non-magnetic Toner (black toner) 1 was produced in the same manner as in the production example of the cyan toner except that 5 parts by mass of carbon black were used instead of 6.0 parts by mass of C.I. Pigment Blue 15:3.

(B) Transparent Toner (T Toner)

Non-magnetic Toner (transparent toner) 1 was produced in the same manner as in the production example of the cyan toner except that no coloring agent such as C.I. Pigment Blue was used.

250 parts by mass of a 0.1M aqueous solution of $Na_3PO_4$ were loaded into 405 parts by mass of ion-exchanged water, and the temperature of the mixture was increased to 60° C. After that, 40.0 parts by mass of a 1.07M aqueous solution of $CaCl_2$ were gradually added to the resultant, whereby the aqueous medium containing the calcium phosphate salt was obtained.

Meanwhile, the following prescription was uniformly dispersed and mixed by the Attritor (manufactured by MITSUI MIIKE MACHINERY CO., LTD.).

| | |
|---|---|
| Styrene: | 80 parts by mass |
| n-butyl acrylate: | 20 parts by mass |
| Divinylbenzene: | 0.2 part by mass |
| Saturated polyester resin (Mw = 41,000): | 4.0 parts by mass |
| Negatively chargeable charge control agent (Al compound of ditertiarybutylsalicylic acid): | 1 part by mass |

The temperature of the monomer composition was increased to 60° C., and 12 parts by mass of ester wax mainly composed of behenyl behenate (having the highest endothermic peak at 72° C. upon heat-up measurement in DSC) were added to, mixed with, and dissolved into the composition. 3 parts by mass of 2,2'-azobis(2,4-dimethylvaleronitrile) [t½=140 minutes at 60° C.] as a polymerization initiator were dissolved into the resultant.

The above polymerizable monomer system was loaded into the aqueous medium, and the whole was stirred by the TK homo mixer (manufactured by Tokushu Kika Kogyo) at 10,000 rpm for 15 minutes in an $N_2$ atmosphere at 60.5° C., followed by granulation. After that, the resultant was subjected to a reaction at 60.5° C. for 6 hours while the resultant was stirred by a paddle stirring blade. After that, stirring was continued for additional 4 hours with the liquid temperature kept at 80° C. After the completion of the reaction, distillation was performed at 80° C. for 3 hours. After that, the suspension was cooled, and was then added with hydrochloric acid so that the calcium phosphate salt was dissolved. The resultant was filtered and washed with water. Thus, wet colored particles were obtained.

Next, the particles were dried at 40° C. for 12 hours, whereby transparent particles (transparent toner particles) were obtained.

100 parts by mass of the toner particles and 1.2 parts by mass of hydrophobic silica fine particles treated with silicone oil and each having a BET value of 130 $m^2/g$ and a primary particle diameter of 12 nm were mixed by a Henschel Mixer (manufactured by MITSUI MIIKE MACHINERY CO., LTD.), whereby Non-magnetic Toner (cyan toner) 1 was obtained.

Non-Magnetic Toner Production Example 2 Non-magnetic Toners 2, that is, colored toners (C, M, Y, and K toners) and transparent toner (T toner) were produced in the same manner as in Non-magnetic Toner Production Example 1 except that the additive of the toner of Non-magnetic Toner Production Example 1 was changed.

In other words, in Non-magnetic Toner Production Example 2, 100 parts by mass of the toner particles and 0.6 part by mass of hydrophobic silica fine particles treated with hexamethyldisilazane and then with silicone oil and each having a BET value of 130 $m^2/g$ and a primary particle diameter of 12 nm were mixed by the Henschel Mixer (manufactured by MITSUI MIIKE MACHINERY CO., LTD.) and used as the extraneous additives of toner, whereby Non-magnetic Toners (colored and transparent toners) 2 were obtained.

(Dual-Component Developing Device)

In this example, the developing device having the construction described above with reference to FIG. 2 was used.

In this example, an aluminum coat sleeve was used as the developing sleeve 40 being the developer carrying member, and a distance between the developing sleeve 40 and each of the photosensitive drums 1 was set to 450 μm. A direct current bias to be applied to the developing sleeve 40 for use in development was −500 V, and an alternating bias was set at a peak-to-peak voltage of 1,200 Vpp and a frequency of 2,000 Hz.

Furthermore, a non-contact-type corona charging method was employed for each of the charging devices 2, and controlling was performed in such a manner that the surface of each of the photosensitive drums would be charged to −650 V.

Each of the photosensitive drums was adapted to have a light electric potential of −100 V at a site where an electrostatic latent image having the maximum image density would be formed through irradiation with a light image. That is, a development contrast was set to 400 V.

EXAMPLE 1

In this example, an image was designed in such a manner that the maximum bearing amount upon formation of the image through the superimposition of colored toners (that is, C, M, Y, and K toners) would correspond to two colors, that is, the maximum bearing amount would be 1.0 $mg/cm^2$. At this time, the maximum toner bearing amount of single colored toner is 0.5 $mg/cm^2$. Non-magnetic Toners No. 1 were used as the colored toners, and Non-magnetic Toner No. 2 was used as transparent toner (T toner). That is, each of the colored toners is added with 1.2 parts by mass of silica as an extraneous additive, and the transparent toner is added with 0.6 part by mass of silica as an extraneous additive. The colored and transparent toners are different from each other in weight ratio of the extraneous additive with respect to toner. In other words, a charge amount is reduced by reducing the amount of the extraneous additive to be added to the transparent toner. 8 parts by mass of each of those toners and 92 parts by mass of Coat Carrier No. 1 were mixed by a V-type mixer, and the mixture was defined as a developer A for starting.

The resultant developer was loaded into each of the developing devices 4 (4*a*, 4*b*, 4*c*, 4*d*, and 4*e*) of the image forming portions corresponding to the toner colors of the image forming apparatus 100 having five stations shown in FIG. 1.

At this time, the triboelectricity of each of the colored toners was −32 μC/g, and the triboelectricity of the transparent toner was −16 μC/g. That is, an absolute value for the charge amount of each of the colored toners per unit weight is 32 μC/g, and an absolute value for the charge amount of the transparent toner per unit weight is 16 μC/g. The absolute value for the transparent toner is smaller than the absolute value for each of the colored toners.

Image formation was performed with such construction. As a result, a development contrast was nearly 400 V, and the development of 0.5 $mg/cm^2$ of each of the colored toners and 1.0 $mg/cm^2$ of the transparent toner, each of the values being the maximum toner amount on a photosensitive drum, was attained.

According to this example, with the above construction, the triboelectricity of the transparent toner is made sufficiently small as compared to that of each of the colored toners, whereby a required toner amount of the transparent toner can be developed at a contrast substantially equal to the development contrast of each of the colored toners. In addition, an electric potential needed for the development of the transparent toner can be secured, and an image can be formed by a toner amount needed for eliminating the irregularities of the image.

In other words, as described above, the triboelectricity of the transparent toner was reduced to be lower than that of each of the colored toners, and the transparent toner was added to a portion corresponding to an image. As a result, the provision of an image forming apparatus capable of: preventing the irregularities and gloss unevenness of toner; and forming an image by the transparent toner in an amount equal to the maximum bearing amount of each of the colored toners with nearly no change in image forming method for each of the colored and transparent toners was attained.

EXAMPLE 2

In this example, Non-magnetic Toners No. 1 were used as colored toners (that is, C, M, Y, and K toners) and transparent toner (T toner). 8 parts by mass of each of the colored toners and 92 parts by mass of Coat Carrier No. 1 were weighed and used. 8 parts by mass of the transparent toner and 92 parts by mass of Coat Carrier No. 2 were weighed. Each of the combinations was mixed by a V-type mixer, and the mixture was defined as a developer B for starting. Then, each of the developers B was loaded into a station corresponding to a toner color of the image forming apparatus.

In Example 1, an image was designed in such a manner that the maximum bearing amount upon superimposition of the colored toners would correspond to two colors, that is, the maximum bearing amount would be 1.0 $mg/cm^2$. In Example 2, an image was designed in such a manner that the maximum bearing amount upon superimposition of the colored toners would correspond to 2.4 colors, that is, the maximum bearing amount would be 1.2 $mg/cm^2$. Therefore, in accordance with the change, the triboelectricity of each of the colored toners is −32 μC/g while the triboelectricity of the transparent toner is a value obtained by dividing (−32 μC/g) by 2.4 (that is, −13 μC/g). To this end, the amount of hydrophobic silica fine particles each serving as an extraneous additive to be added to Non-magnetic Toner No. 1 was adjusted to be lower than that in the case of Example 1.

In addition, an appropriate value for the triboelectricity of the transparent toner in this example can be determined as described below. That is, the value can be determined by multiplying the triboelectricity of each of the colored toners (for example, 32 μC/g) by a ratio of the maximum bearing amount of single colored toner (for example, 0.5 $mg/cm^2$) to the maximum bearing amount upon superimposition of colored toner images (for example, 1.2 $mg/cm^2$) (0.5/1.2=0.42) (32×0.42=13 μC/g).

An image was formed by the toner together with Coat Carrier No. 1. As a result, a development contrast was nearly 400 V, and the development of 0.5 $mg/cm^2$ of each of the colored toners and 1.2 $mg/cm^2$ of the transparent toner, each of the values being the maximum toner amount on a photosensitive drum, was attained.

The triboelectricity of non-magnetic toner can be adjusted depending on the amount of an extraneous additive to be added, and can also be adjusted by changing the material for the toner from hydrophobic silica fine particles to any other kind of material. This is because different materials differ from each other in triboelectrification property. Any one of the above-described examples of the extraneous additive may be appropriately selected and used. The term "triboelectrification property" as used herein refers to charging polarity and charged charge amount upon friction between materials of the same kind.

In this example, the triboelectricity of the transparent toner was reduced in proportion to the number of colors of the colored toners each having the maximum bearing amount by adjusting, for example, the kind or amount of an extraneous additive. Thus, an image was formed by the transparent toner in an amount equal to the maximum bearing amount of each of the colored toners, the transparent toner was added to a portion corresponding to the image, and the prevention of the irregularities and gloss unevenness of toner was attained with nearly no change in image forming method for each of the colored and transparent toners.

EXAMPLE 3

In this example, as in the case of Example 1, an image was designed in such a manner that the maximum bearing amount upon superimposition of the colored toners would be 1.0 mg/cm$^2$.

Non-magnetic Toners No. 1 were used as colored toners (C, M, Y, and K toners) and transparent toner (T toner). The carrier to be used in each of the colored toners was obtained by sieving Coat Carrier No. 2 with a mesh to have an average particle diameter of 25 μm. The carrier to be used in the transparent toner was obtained by changing the average particle diameter of Coat Carrier No. 2 to 35 μm. 8 parts by mass of each of those toners and 92 parts by mass of the corresponding coat carrier were weighed and mixed by a V-type mixer, and the mixture was defined as a developer C for starting. The developer was loaded into a station corresponding to a toner color of the image forming apparatus.

At this time, the triboelectricity of each of the colored toners was −34 μC/g while the triboelectricity of the transparent toner was −15 μC/g.

An image was formed with such construction. As a result, a development contrast was nearly 400 V, and the development of 0.5 mg/cm$^2$ of each of the colored toners and 1.0 mg/cm$^2$ of the transparent toner, each of the values being the maximum toner amount on a photosensitive drum, was attained.

As the average particle diameter of the carrier reduces, the number of particles increases for the same weight, and the surface area also increases. Accordingly, the charging ability of toner is expected to increase, and the triboelectricity of the toner is also expected to increase.

Another aspect of the carrier except its particle diameter affects the triboelectricity of toner.

As shown in Table 1 above, the carrier may be adjusted to be suitable for desired toner triboelectricity by changing the amount of each of the primer agent, the coat agent, and the coupling agent.

For example, any one of the above-described various surface-treated resins can be used as each of the primer agent, the coat agent, and the coupling agent. The kind and addition amount of a material are desirably adjusted so that desired triboelectrification property is obtained because different triboelectrification properties can be obtained depending on the charging sequence of a selected material.

As described above, in this example, the triboelectricity of the transparent toner was reduced to be lower than that of each of the colored toners by changing the particle diameter of a carrier. Thus, an image was formed by the transparent toner in an amount equal to the maximum bearing amount of each of the colored toners, the transparent toner was added to a portion corresponding to the image, and the prevention of the irregularities and gloss unevenness of toner was attained with nearly no change in image forming method for each of the colored and transparent toners.

EXAMPLE 4

Figure 7:
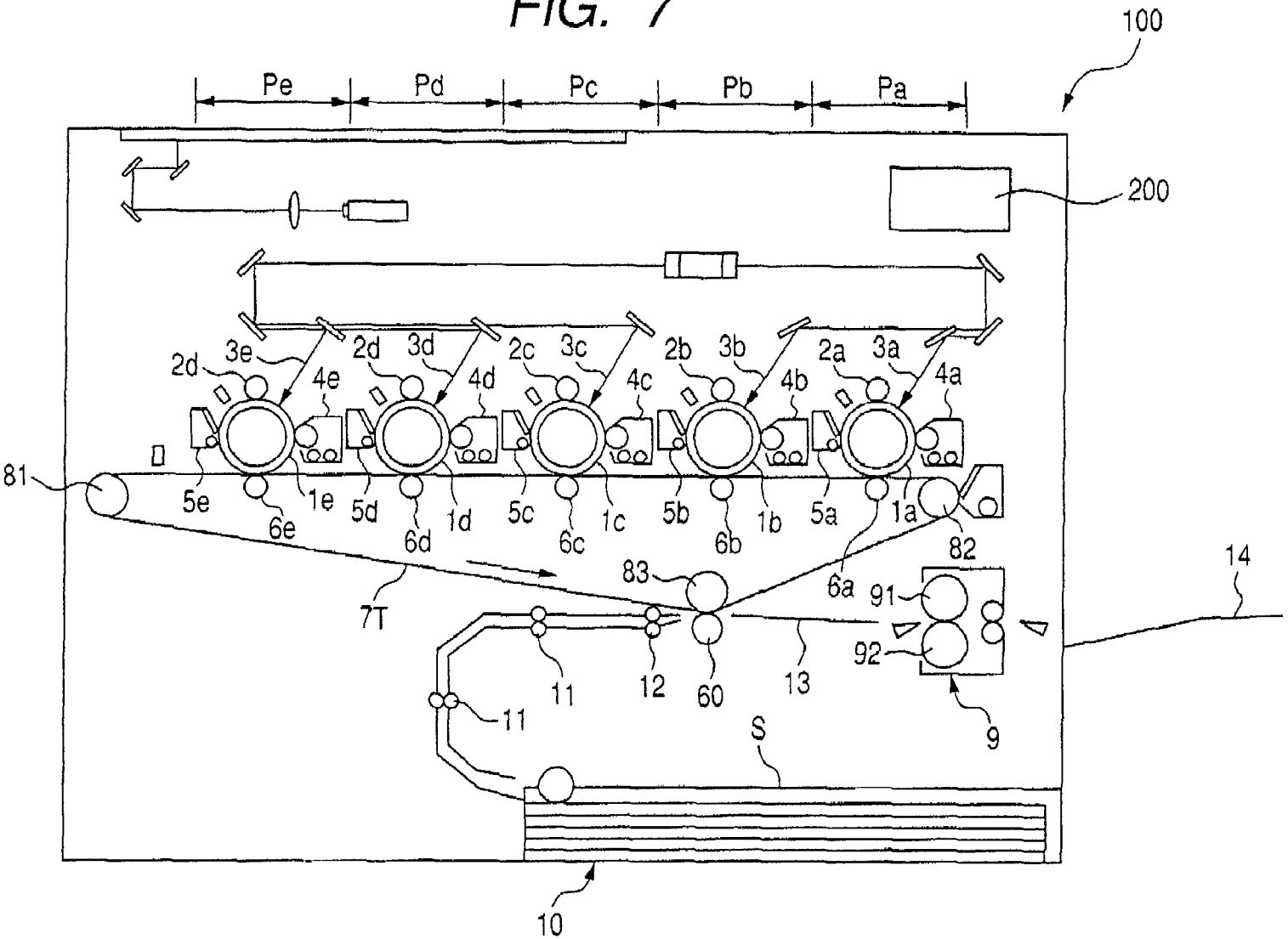
FIG. 7 is a view showing the schematic construction of another example of the image forming apparatus according to the present invention.

FIG. 7 shows the schematic construction of a color image forming apparatus according to an intermediate transfer method as another example of the present invention.

In this example, the image forming apparatus 100 has the same construction as that of the full-color (four-color) electrophotographic image forming apparatus according to an in-line method described in each of Examples 1 to 3 except for the following point. In the image forming apparatus 100 of each of Examples 1 to 3, toner images formed on the surfaces of the photosensitive drums 1 are directly and sequentially transferred on the recording material S conveyed by the conveying belt 7 to the respective image forming portions P (Pa, Pb, Pc, Pd, and Pe) to record a color image. In this example, however, a belt-shaped intermediate transfer body 7T is arranged instead of the conveying belt 7.

Therefore, the same reference numeral is given to a member having the same construction and function as those of the image forming apparatus of each of Examples 1 to 3, the description of each of Examples 1 to 3 is cited, and overlapping description is omitted.

As described above, unlike Examples 1 to 3, in this example, at first, toner images formed on the surfaces of the respective photosensitive drums 1 are sequentially transferred on the intermediate transfer belt 7 to form a color image. Next, the color image on the intermediate transfer belt 7 is transferred on the recording material S separated and fed from the recording material cassette 10 by applying a voltage to a transfer roller 60 as secondary transfer means.

Next, the recording material S is conveyed to the fixing device 9, and heat and pressure are applied to the recording material S, whereby the transferred toner image is fixed. After that, the recording material S is discharged to the discharge portion 14.

Even in the color image forming apparatus according to an intermediate transfer method of this example, the triboelectricity of transparent toner is made sufficiently small as compared to that of each of the colored toners in the same manner as in Example 1. As a result, a required toner amount of the transparent toner can be developed at a contrast substantially equal to the development contrast of each of the colored toners. In addition, an electric potential needed for the development of the transparent toner can be secured, and an image can be formed by a toner amount needed for eliminating the irregularities of the image.

In addition, in the same manner as in Example 2, the triboelectricity of the transparent toner is reduced in proportion to the number of colors of the colored toners each having the maximum bearing amount by adjusting, for example, the kind or amount of an extraneous additive. Thus, an image is formed by the transparent toner in an amount equal to the maximum bearing amount of each of the colored toners, the transparent toner is added to a portion corresponding to the image, and the irregularities and gloss unevenness of toner can be prevented with nearly no change in image forming method for each of the colored and transparent toners.

Furthermore, in the same manner as in Example 3, the triboelectricity of the transparent toner is reduced to be lower than that of each of the colored toners by changing: the particle diameter of the core of a carrier; a material for the coat of the core (that is, a coat resin and/or a coupling agent); or the addition amount of the material. Thus, an image is formed by the transparent toner in an amount equal to the maximum bearing amount of each of the colored toners, the transparent toner is added to a portion corresponding to the image, and the irregularities and gloss unevenness of toner can be prevented with nearly no change in image forming method for each of the colored and transparent toners.

This application claims priority from Japanese Patent Application No. 2005-162058 filed Jun. 1, 2005, and Japanese Patent Application No. 2006-105753 filed Apr. 6, 2006 which are hereby incorporated by reference herein.

What is claimed is:

1. An image forming apparatus comprising:

colored toner image forming devices each forming an electrostatic image and developing the electrostatic image with colored toner to form a colored toner image, the colored toner image forming devices forming toner images by colored toners different from each other;

a transparent toner image forming device forming an electrostatic image and developing the electrostatic image with transparent toner to form a transparent toner image, the transparent toner having a charge amount per unit weight smaller than a charge amount of each of the colored toners per unit weight; and a transfer device superimposing and transferring the colored toner images and the transparent toner image on a transfer medium.

2. An image forming apparatus according to claim 1, wherein a maximum toner bearing amount per unit area when the colored toners different from each other are superimposed on the transfer medium is 2 to 2.5 times as high as a maximum toner bearing amount of one kind of colored toner per unit area.

3. An image forming apparatus according to claim 1, wherein the colored toners different from each other are different from each other in color.

4. An image forming apparatus according to claim 1, in which an extraneous additive extraneously added to each of the colored toners and an extraneous additive extraneously added to the transparent toner are different from each other in triboelectrification property.

5. An image forming apparatus according to claim 1, wherein the extraneous additive extraneously added to each of the colored toners and the extraneous additive extraneously added to the transparent toner are different from each other in weight ratio with respect to toner.

6. An image forming apparatus according to claim 1, wherein:

each of the colored toners and the transparent toner comprises non-magnetic toner, and is mixed with a magnetic carrier to be used as a dual-component developer; and a magnetic carrier mixed with each of the colored toners and a magnetic carrier mixed with the transparent toner are different from each other in triboelectrification property.

7. An image forming apparatus according to claim 6, wherein:

each of the magnetic carriers is obtained by forming a coating layer on a surface of a magnetic core; and a magnetic core of the magnetic carrier mixed with each of the colored toners and a magnetic core of the magnetic carrier mixed with the transparent toner are different from each other in particle diameter.

8. An image forming apparatus according to claim 6, wherein:

each of the magnetic carriers is obtained by forming a coating layer on a surface of a magnetic core; and a coating layer of the magnetic carrier mixed with each of the colored toners and a coating layer of the magnetic carrier mixed with the transparent toner are different from each other in triboelectrification property.

9. An image forming apparatus according to claim 1, further comprising:

a fixing device fixing the superimposed toner images on the transfer medium;

a controlling device controlling an image forming operation by the transparent toner image forming device in such a manner that heights of the superimposed toner images fixed by the fixing device are substantially constant.

* * * * *